US005647437A

United States Patent [19]

Braddick et al.

[11] Patent Number: 5,647,437

[45] Date of Patent: Jul. 15, 1997

[54] THRU TUBING TOOL AND METHOD

[75] Inventors: Britt O. Braddick; Allen Kent Rives, both of Houston, Tex.

[73] Assignee: TIW Corporation, Houston, Tex.

[21] Appl. No.: 691,348

[22] Filed: Aug. 2, 1996

Related U.S. Application Data

[62] Division of Ser. No. 223,704, Apr. 6, 1994, Pat. No. 5,566, 762.

[51] Int. Cl.[6] ..... E21B 7/08; E21B 23/00

[52] U.S. Cl. ..... 166/382; 166/117.6; 166/217

[58] Field of Search ..... 166/382, 117.5, 166/117.6, 208, 217, 123, 181, 182, 242, 243; 175/258, 262, 264, 274, 275, 276

[56] References Cited

U.S. PATENT DOCUMENTS

| | | | |
|---|---|---|---|
| 3,993,128 | 11/1976 | Braddick | 166/212 |
| 3,999,605 | 12/1976 | Braddick | 166/216 |
| 4,688,642 | 8/1987 | Baker | 166/382 |
| 4,942,924 | 7/1990 | Duncan | 166/382 X |
| 5,154,231 | 10/1992 | Bailey et al. | 166/117.6 X |
| 5,168,942 | 12/1992 | Wyndrinski | 175/258 |
| 5,193,620 | 3/1993 | Braddick | 166/117.5 X |

*Primary Examiner*—Terry Lee Melius
*Attorney, Agent, or Firm*—Browning Bushman

[57] ABSTRACT

This arrangement and method enables a window to be milled in casing (C) without first removing smaller diameter tubing (T) from the casing (C). An expandable anchor (A) has movable members (14), (19) on top expander (8) and bottom expander (12) which support slip means (21) in retracted position to enable passage through smaller diameter tubing (T) extending into larger diameter casing (C). Actuation of a work string (HSS or WSS) in a manner well known to those skilled in the art expands, or moves the members to secure the slip means and anchor (A) in larger diameter casing C. A whipstock tool including a whipstock W, a hinge assembly H, a centering device, and an orienting sub (OS). A latch assembly (LA) is then run on a workstring (WS) through the smaller diameter tubing (T) and engaged in orienting slot (7) in the riser 2 of Anchor A and a mill (57) on the workstring mills a window in the casing when the workstring is moved along the whipstock.

19 Claims, 12 Drawing Sheets

FIG. 3
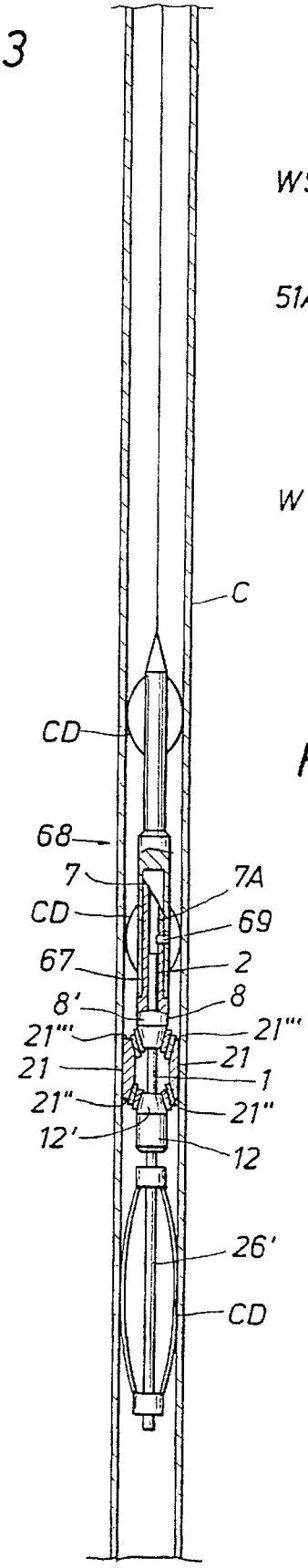
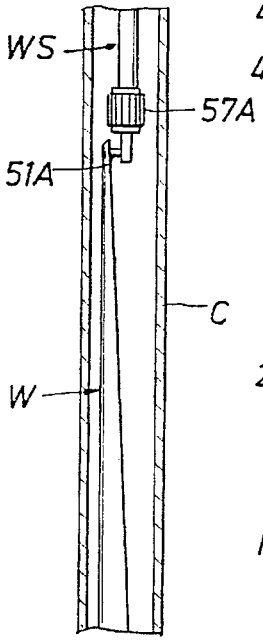
FIG. 23
FIG. 4
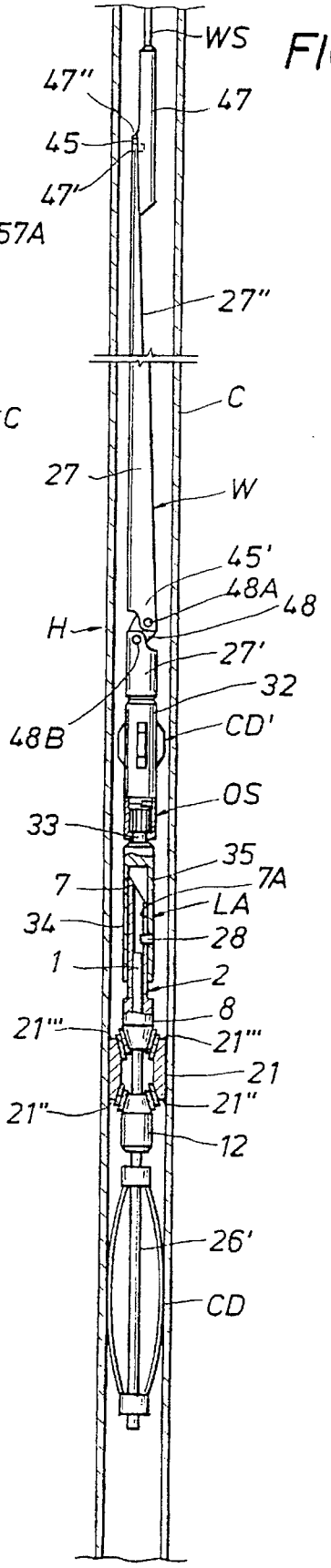

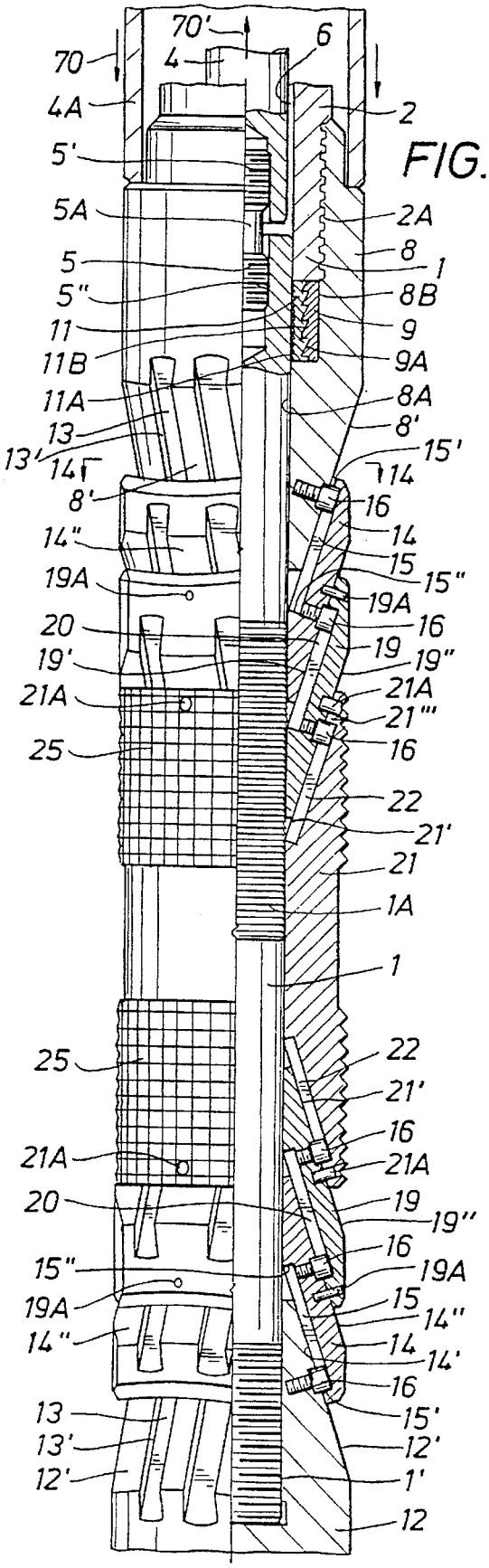
FIG.10
FIG.11
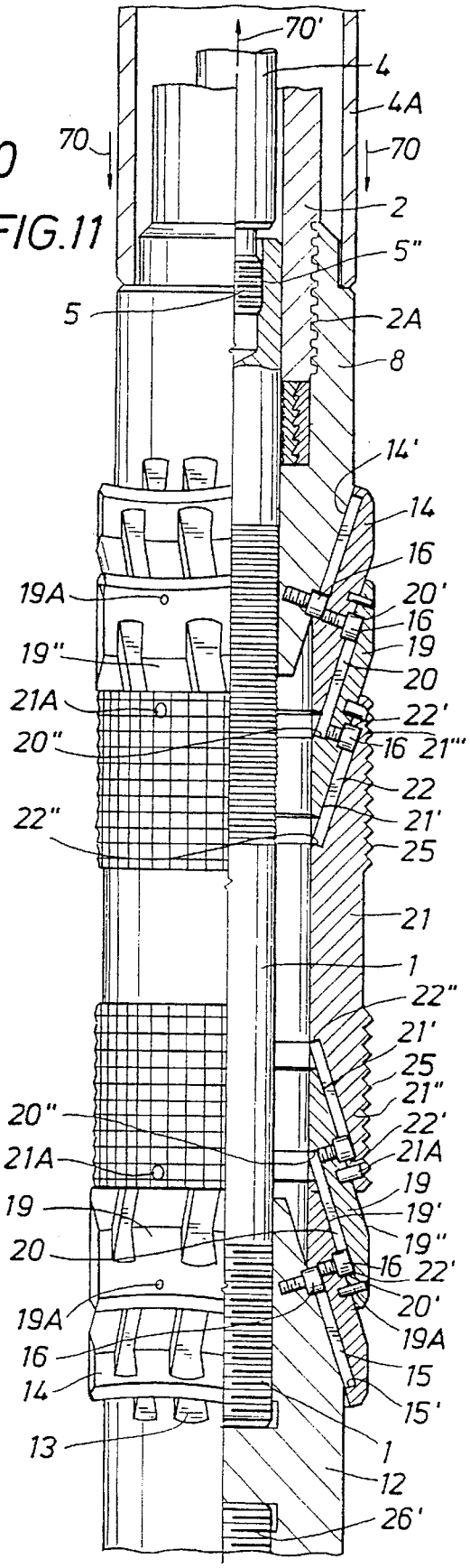

FIG. 14
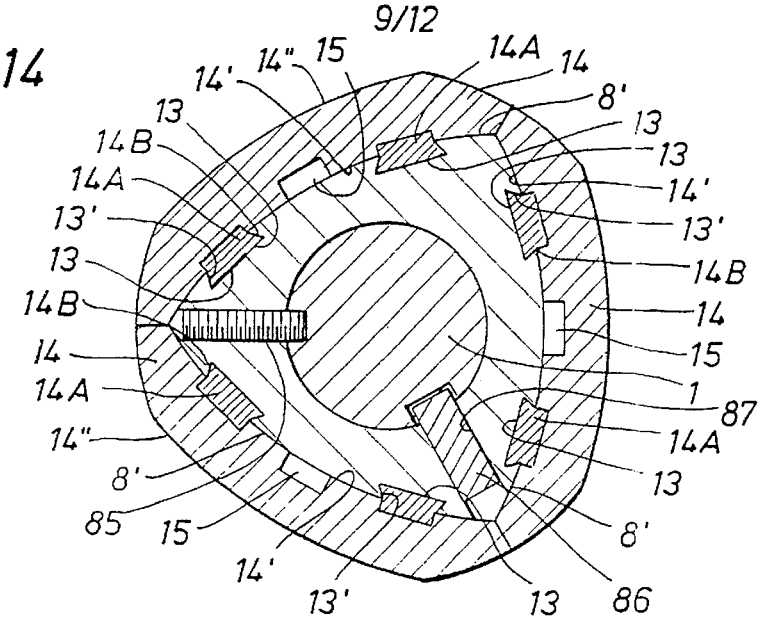
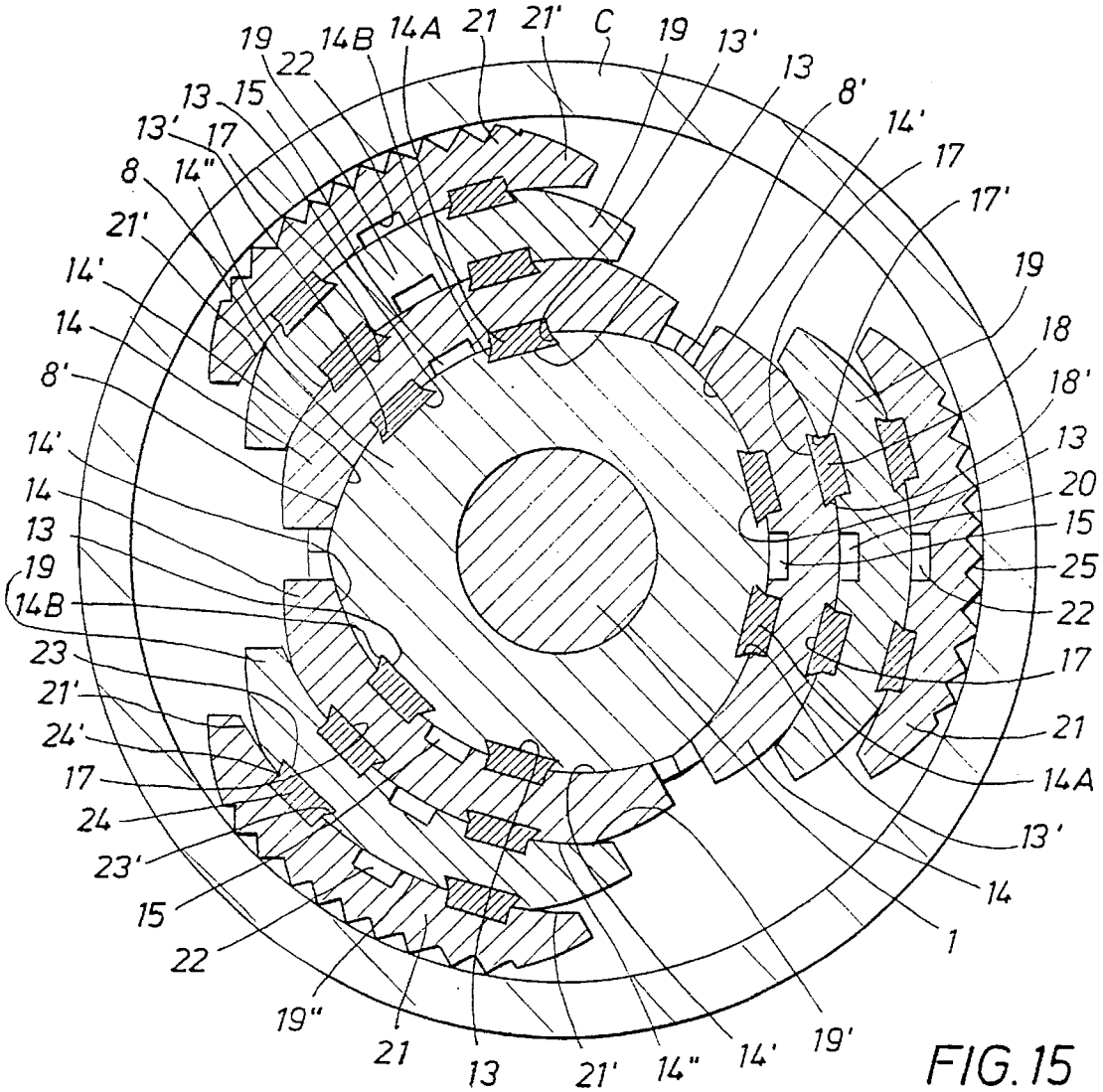
FIG. 15

THRU TUBING TOOL AND METHOD

This is a Division of application Ser. No. 08/223,704, filed Apr. 6, 1994 , now U.S. Pat. No. 5,566,762. This application relates to copending application Ser. No. 07/996, 958 filed Dec. 23, 1992.

STATEMENT OF THE PRIOR ART

Use of whipstocks in drilling to direct or deviate a drill bit or cutter at an angle from a cased well bore is well known in the art. It has heretofore been generally customary in most instances to initially set a cement plug, a packer and a whipstock at the desired elevation in a well tubular member such as a casing to support the whipstock to enable such operations to be carried out.

Where it is desired to cut or mill a window in casing in a wellbore which has tubing therein for conducting flow from a well bore, it has heretofore been necessary to first remove the smaller diameter tubing string from the well bore, quite often at considerable expense, to permit full-bore entry into the casing to enable the anchor and the whipstock to be lowered into and positioned in the larger diameter casing for milling or cutting the window in the casing. The orienting of the whipstock has heretofore been accomplished in a well known manner to those skilled in the art of whipstock use and generally requires a multiple trip operation into and out of the cased well bore.

The setting of anchors, orientable latch assemblies and whipstocks in casing strings cemented within well bores for purposes of milling windows for side-tracking the well bores has been performed for many years. However, apparatus and methods have not heretofore existed which permitted such operations to be carried out and performed by passage through the inside of the smaller tubular members such as, by way of example only, production tubing string positioned within the casing.

Removal of the tubing from the casing to provide access to the casing with present tools to mill a window in the casing, as presently performed, results in the consumption of a considerable amount of time and expense.

SUMMARY OF THE INVENTION

The present invention provides an arrangement and method for lowering an expandable anchor through smaller diameter tubing or member that is surrounded by casing in a location, such as a well bore, and then moving movable members supported by the anchor mandrel laterally relative to the anchor mandrel to expand the expandable anchor to secure it with the casing.

Either the azimuth of an orientation slot or the radial location of an orientation slot associated with the anchor is determined by lowering a survey mechanism, of a form well known in the art, into the slot in the anchor riser.

The whipstock is then adjusted at the earth's surface to position the whipstock to face in the desired manner based on the survey which enables the set anchor, once set, to orient a tool such as a whipstock tool in a determined manner for cutting or milling a window in the casing after it is lowered to lock in the anchor.

One of the objects of the present invention is to provide a new and useful tool arrangement and method for side-tracking a well bore by milling a window in the side of a casing string cemented in the wellbore in which a smaller diameter tubing string is present in the casing above where the window is to be cut without first removing the smaller internal diameter tubing from the casing.

Another object of the invention is to provide an expandable anchor which may be retained in collapsed position to enable it to be moved through tubing having a substantially smaller internal diameter than the casing in which the expandable anchor is to be secured so that a whipstock may then be secured on the the anchor for milling or cutting of the window, which eliminates the expense of first removing the smaller tubing from the casing.

Another object of the invention is to provide a tool arrangement and method for thru-tubing milling of windows in casing which includes an anchor, complete with orientation capabilities, capable of being run through the production tubing string and set in the casing string, by either an electric wire line using a pressure setting assembly or conventional coupled or coil tubing using a hydraulically actuated setting tool.

Yet a further object of the invention is to provide an arrangement and method for maintaining an expandable anchor collapsed to move through small internal diameter members and then incrementally expanding the anchor to secure in larger diameter pipe.

A further object of the invention is to provide a method and apparatus for forming a window in casing which has smaller diameter pipe extending in the casing above the location in the casing where the window is to be formed without first removing the smaller diameter pipe.

A still further object of the invention is to provide a tool arrangement including an expandable anchor for positioning in a casing through a smaller diameter tubing or pipe and then expanded to secure with the casing.

Yet a further object of the invention is to provide an arrangement to enable a whipstock to be lowered through a small diameter tubing and secured in a larger diameter casing to face in any desired predetermined azimuth or radial location for drilling a window in the casing without first removing the small diameter tubing to gain access to the casing.

A further object is to provide a method for securing an expandable anchor in a casing against both longitudinal and rotational movement into which casing a smaller diameter tubing extends by passing the anchor through the smaller diameter tubing and then securing the anchor with the casing and thereby avoid the expense, delay and trouble of first removing the tubing before positioning the anchor in the casing.

Another object is to provide a latch for securing with an anchor to lock a tool with the anchor in a desired relationship.

Another object is to provide a latch for securing with an anchor to lock a tool with the anchor in a desired relationship wherein the anchor is positioned in a casing into which casing a smaller diameter tubing extends by passing the anchor through the smaller diameter tubing and then securing the anchor and engaging slips with the larger diameter casing and thereby avoid the expense, delay and trouble of first removing the tubing before positioning the anchor in the casing.

Still another object is to provide an anchor and method for enabling it to pass through restricted diameter tubing before being enlarged to secure in larger diameter members.

Another object is to provide a method and arrangement including an anchor that supports slips whereby the slips may be retained collapsed on the anchor to pass through small diameter pipe and then spaced outwardly to secure the anchor in a larger diameter member in which the small diameter pipe extends for receiving a tool on the anchor to mill a window in the larger diameter pipe.

Other objects and advantages of the present invention will become more readily apparent from a consideration of the following drawings and description.

BRIEF DESCRIPTION OF THE DRAWINGS

FIG. 3 schematically illustrates the anchor expanded and set within the casing and a survey tool lowered into and releasably supported in the expanded anchor to determine the azimuth of the orientation slot in the riser of the set, expanded anchor or the radial location of the orientation slot relative to the casing;

FIG. 4 schematically illustrates the anchor set in the casing, engaged with a form of a whipstock tool, or tool arrangement including an orientable latch assembly, centering device, hinge and the unset whipstock with the whipstock work string WS attached;

FIG. 10 is a a quarter section view of the center portion of the expandable anchor with the movable members or expanders in a collapsed or retracted position to move through the smaller diameter tubular member (upper portion of riser in FIG. 8 and lower centralizer CD shown in FIG. 1 are not depicted in FIG. 10) and the lower end of one form of the setting sleeve of the work string shown in half section abutting the top expander of the collapsed anchor and the work string shown in partial quarter section releasably connected to the mandrel of the anchor;

FIG. 11 is a view similar to FIG. 10 illustrating the anchor after completion of the first sequence in setting the anchor within the casing with the slips supported thereon moved toward the casing by outward movement of the inner movable members along the inclined external curved surfaces of the upper and and lower expanders;

FIG. 14 is a cross section on the line 14—14 of FIG. 10, illustrating the position of the movable members and slips of the invention when in collapsed or retracted position on the anchor;

FIG. 15 is a cross section on the line 15—15 of FIG. 13, illustrating the movable members and slips in the expanded and set position;

FIG. 23 schematically illustrates a modified upper end portion of the whipstock tool arrangement for forming a window in the casing.

DESCRIPTION OF THE PREFERRED EMBODIMENT

Figure 1:
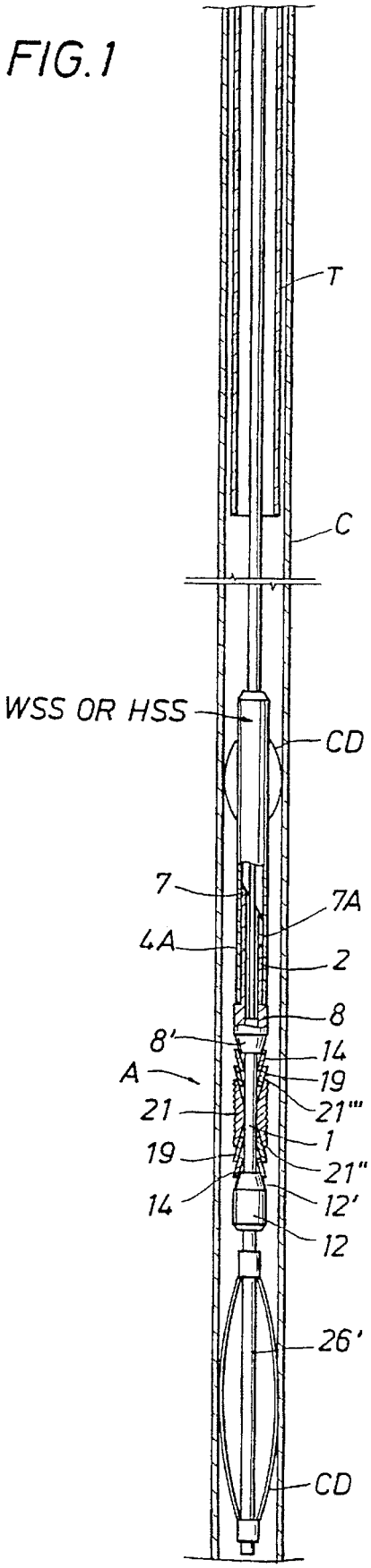
FIG. 1 schematically illustrates the anchor suspended on an electric wireline or hydraulic setting tool and as having passed through a smaller diameter tubing that extends into a larger diameter casing in which larger diameter casing the expandable anchor is to be secured.

The present invention includes an anchor as shown in FIG. 10 which comprises a mandrel 1 with a riser 2 extending upwardly from the top expander 8 with which the mandrel 1 is secured and a bottom expander 12 threadedly connected at 1' adjacent the lower end of the mandrel below the upwardly extending riser.

Multiple groups of movable members, or expanders, are supported on the periphery of the top expander and multiple groups of movable members, or expanders, are supported on the periphery of the bottom expander.

FIG. 14 illustrates three groups of movable members, or expanders, which equals the number of external curved surfaces 8' and 12', respectively, on each the top expander 8 and bottom expander 12; however, this is by way of example only as the number of external curved surfaces and the number of groups of upper and lower cooperating movable members, or expanders, which equals the number of external curved surfaces may vary as desired.

In one preferred embodiment, the multiple groups of movable members, or expanders, comprise upper groups including a movable inner member, or expander, 14 and an outer movable member, or expander, 19 supported on the top expander 8. Lower groups include a movable inner member, or expander, 14 and a lower movable outer member, or expander 19 supported on the bottom expander 12.

In assembly of the anchor A at the earth's surface, the mandrel 1 is connected in any suitable manner, such as a threaded connection by way of example only, with the bottom expander 12. The top expander 8 is threadedly connected with the riser 2, and the mandrel 1 and the top expander 8 are provided with a suitable frangible means, such as by way of example only, shear pin 85 extending therebetween, as seen in FIG. 14, to inhibit premature relative longitudinal movement between the mandrel 1 of the anchor and the riser 2. A key 86 and key way 87, shown in FIG. 14 inhibit relative rotation between the anchor mandrel 1 and the top expander 8 which slidably receives the anchor mandrel when the work string is actuated. A limit pin 16 limits the range of slideable movement between each of the upper and lower inner movable members, or expanders 14 Interacting dove-tail keys and keyways secure the upper and lower inner members, or expanders 14, with the top expander 8 and bottom expander 12, as will be described in detail hereinafter.

The groups of upper and lower movable members are aligned and have slips or slip segments 21 connected adjacent their upper ends and lower ends, respectively, and extending between the aligned upper and lower outer movable members, or expanders, as shown in the drawings.

The groups of upper movable members and lower movable members, or expanders, and slip segments, or slips connected between the upper and lower aligned groups of movable members are collapsed, or retracted to a position adjacent the anchor mandrel 1 as they are assembled and then lowered by a setting tool through the smaller diameter tubing and into the casing or larger diameter tubular member as illustrated schematically in FIG. 1 and shown in FIG. 10 of the drawings.

The setting tool is then actuated which provides forces to move the movable members, or expanders, progressively, or sequentially as hereinafter explained to space the slip segments outwardly away from the anchor mandrel until the slips engage the casing C to secure the anchor within the larger diameter casing or tubular member for whatever purpose may be desired.

If a window is to be formed in the casing, a whipstock tool W is assembled at the earth's surface, as shown in FIG. 4, in its preferred embodiment. It is shown as including when assembled a hinge assembly H supported by whipstock sub 27'. The hinge link 48 on the hinge assembly H is connected adjacent the lower end of the whipstock body 45'. A centering device CD' is threadedly connected with the lower end of the whipstock sub 27' and the centering device CD' is threadedly connected at its lower end with orienting sub or arrangement OS which is has an orienting mandrel 33 which threadedly connects with the body 34 of the latch assembly LA as schematically shown in FIG. 4. The latch assembly body 34 includes latch housing 35 which telescopes over the riser 2 when the whipstock tool is lowered to the anchor A, as better seen in FIGS. 8 and 9.

All of the above components must be of a size to pass through the smaller diameter tubing T, as seen in FIG. 1 for positioning in the larger diameter casing C.

After the anchor A is set and after a survey, as will be explained, has been conducted to determine the azimuth of the orientation slot 7A in the riser 2 of the anchor A, or the radial location of the orientation slot relative to the casing C, the assembled whipstock tool W is lowered on a workstring WS through the smaller diameter tubing and secured by the the anchor A in the larger diameter pipe.

Figure 9A:
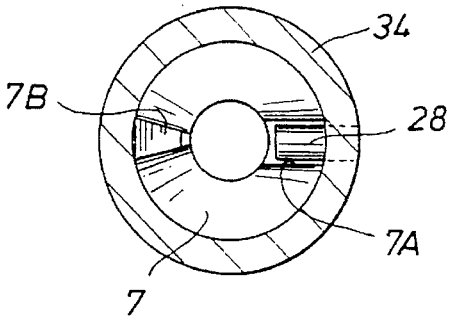
FIG. 9A is a cross section view on the line 9A—9A of FIG. 9 illustrating the key of the orientable latch assembly engaged with the orientation slot of the anchor riser and the chamfer on the upper biased edge of the riser opposite the orientation slot.
Figure 8:
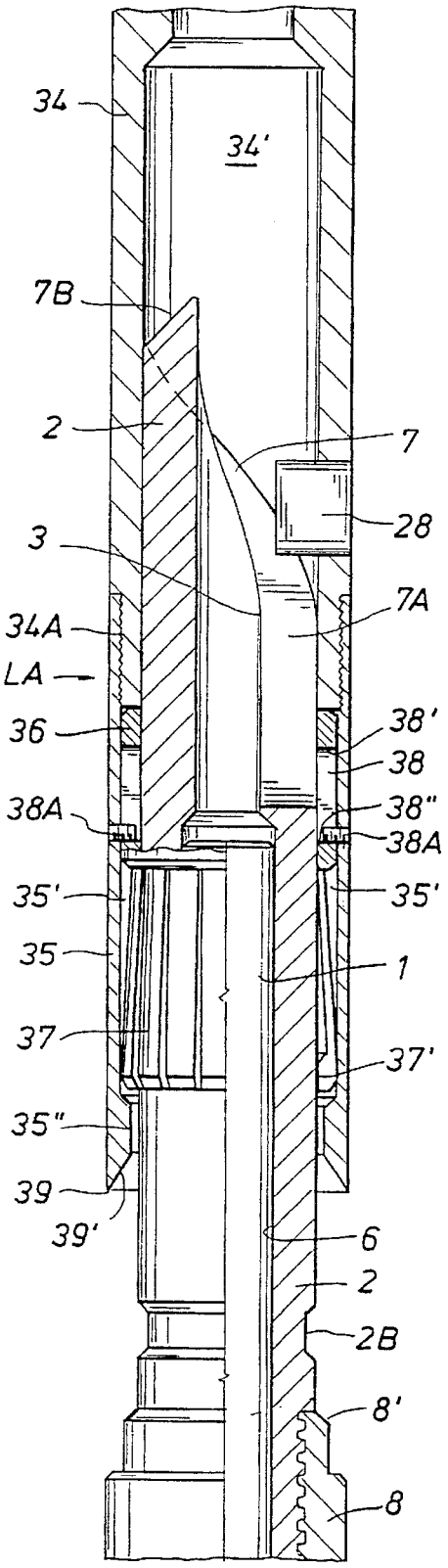
FIG. 8 is a partial half section of the latch assembly partially engaged with the anchor riser slot which is shown in half section at its upper end and in quarter section at its lower end.
Figure 9:
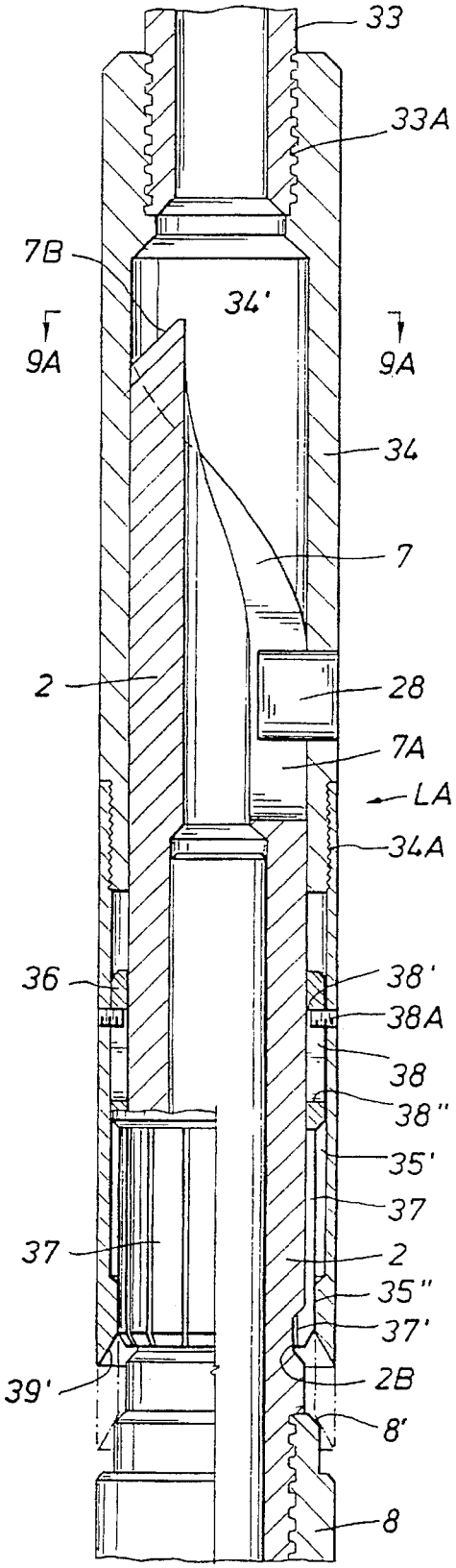
FIG. 9 is a partial half section view illustrating the key of the orientable latch assembly engaged with the orientation slot of the anchor riser.

The latch assembly, represented generally at LA orients the whipstock tool to face in the desired manner as lug 28 thereon engages the biased edge 7 on the riser 2 and is guided to engage the orientation slot 7A of the anchor A as better seen in FIGS. 8 and 9 when the assembled whipstock tool is lowered in the casing C to engage the Anchor A.

The window is then formed by moving a work string with a mill or cutter thereon through the smaller diameter tubing and then along the face of the whipstock to contact the larger diameter tubular member, or casing to mill a window therein by rotation of the well string, or by use of a down hole motor to rotate the mill, in a manner well known to those skilled in the art, as will be described in greater detail hereinafter.

The present invention will be described, by way of example only and not by way of limitation, wherein the upper and lower groups of movable members, or expanders, comprise only two movable members in each group, identified herein as an inner and an outer movable member, or expander, respectively, with a slip segment or slips connected to and extending between each upper and lower group of outer movable members, or expanders, 19.

However, it should be noted that the number of laterally movable members, or expanders may be determined by the size of the tubular member in which the invention is employed, and the thickness of the movable members and the slips, as well as the internal diameter through which the expandable anchor must pass before it reaches the location in the larger diameter tubular member where it is to be secured. In those instances where more than two movable members are employed, they may be referred to by any suitable term such as, by way of example only, as the inner, intermediate and outer movable members, or expanders, respectively.

The present invention will be described in detail as it applies to its use in well bores, but it may be employed in any situation where is it desired to move a tool, or other object through a restricted passage or opening and then secure a tool or an object in a larger diameter bore or to have available the ability to orient a tool after moving it through a restricted bore into a larger diameter bore.

By way of example only and without limitation, the present invention will be described for use with 4 ½ inch O.D. tubing, with 3 13/16 inch I.D. which extends into casing with 7 inch O.D. having an I.D. of 6.184 inches.

Attention is first directed to FIGS. 1 through 4 of the drawings wherein the present invention is schematically illustrated. The casing of a well bore is illustrated at C into which extends a smaller diameter tubing production string represented at T.

Figure 20:
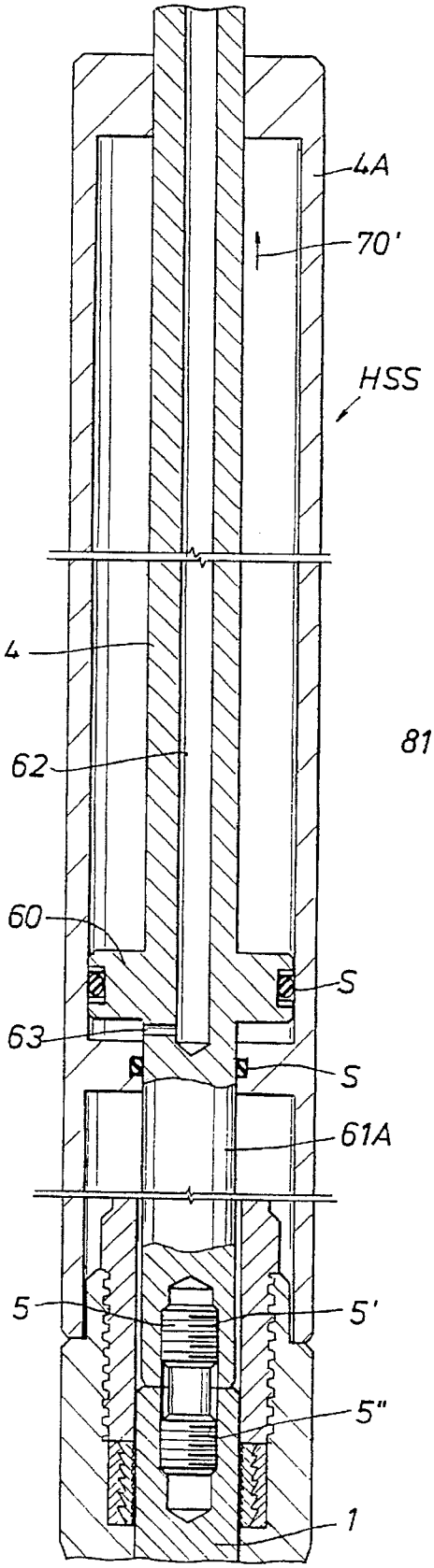
FIG. 20 is a schematic one half sectional view illustrating one suitable form of a hydraulically actuated setting tool and a shear stud as the releasable connection between the setting tool and the anchor mandrel.
Figure 22:
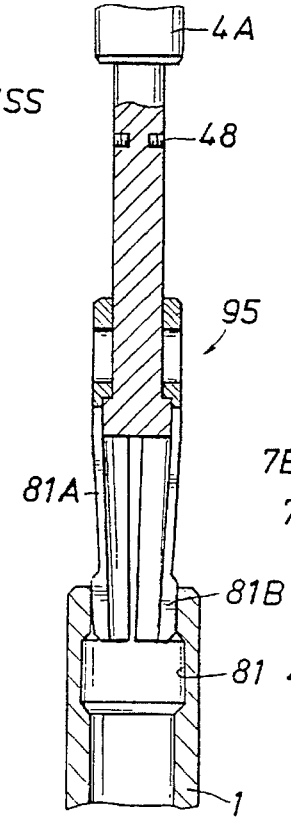
FIG. 22 is a schematic view showing the latch in released position after the wireline setting tool has been actuated and released from the anchor mandrel.
Figure 21:
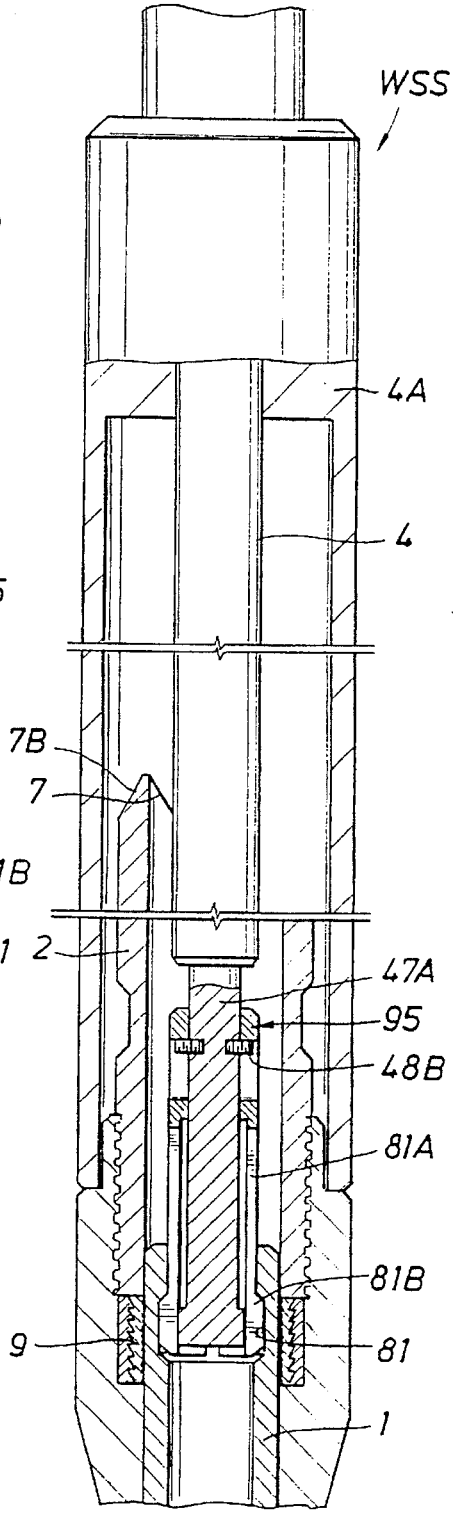
FIG. 21 is a schematic view of a wireline actuated setting tool and a form of a latch which may be used as the releasable connection with an anchor mandrel that has a counter bore or tubular passage therein.

A setting tool represented generally by WSS or HSS in FIG. 1 may be a wireline setting tool which is schematically shown in FIG. 21 and represented generally by WSS, or a hydraulic setting tool represented generally at HSS in FIG. 20. Both types of setting tools include a setting tool mandrel 4 which is connected by a frangible member, such as a shear stud 5 with the mandrel 1 of the anchor A, as seen in FIG. 20, or a latch, represented generally at 95, releasably connected with to the anchor mandrel 1, as shown in FIGS. 21 and 22. Both types of setting tools are furnished with a setting sleeve 4A which abuts the top expander 8 when either setting tool is employed with the present invention.

Figure 6:
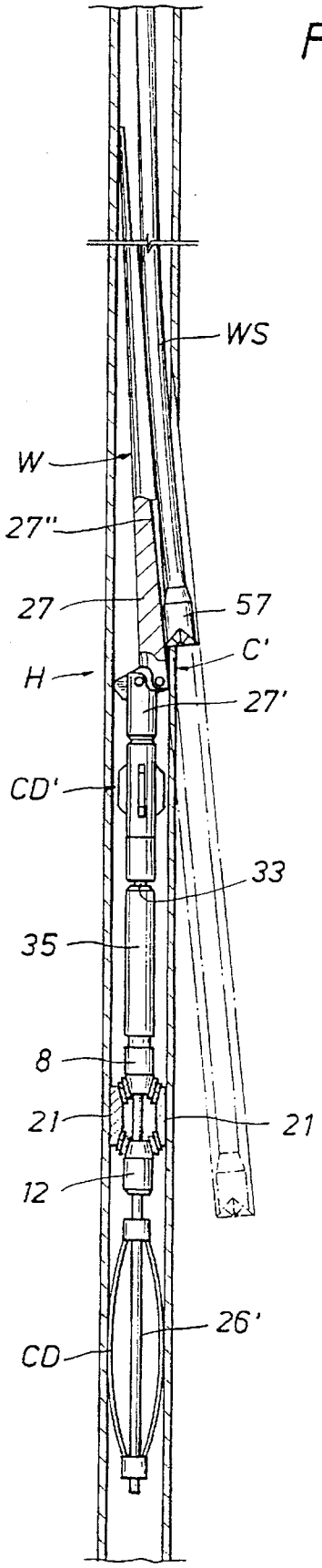
FIG. 6 schematically illustrates the anchor and whipstock tool arrangement, set within the casing and a work string WS with a window mill attached positioned in the trough, or face of the whipstock. The window in the casing is shown as partially milled with the dotted line projecting the path of the mill and work string upon completion of the window milling operation.

The term workstring (WS) as used herein is normally composed of ordinary coupled tubular members or coil tubing and is employed for lowering and/or manipulating a tool, such as the whipstock tool of the present invention as illustrated in FIGS. 4 and 6 of the drawings.

Figure 2:
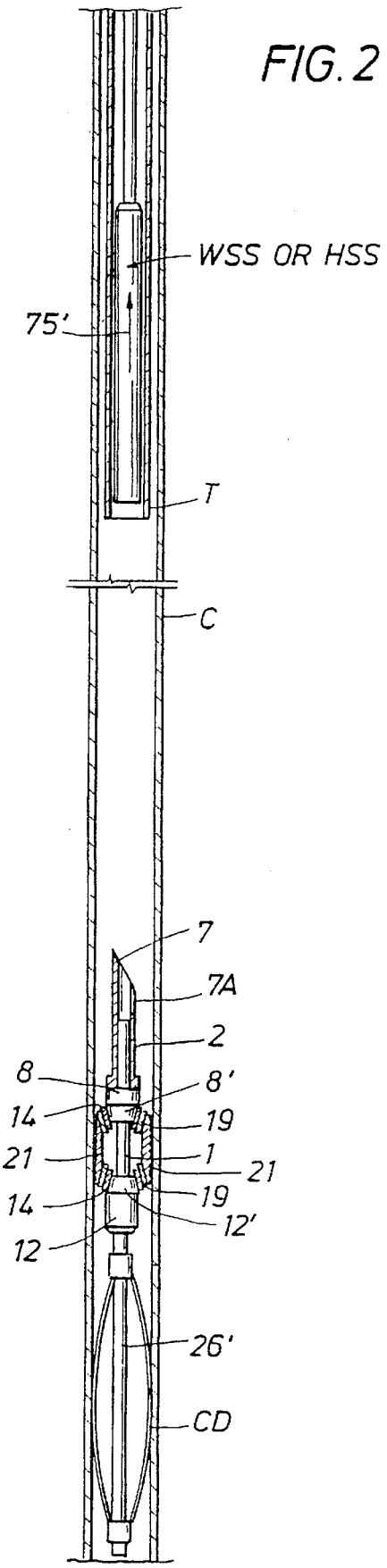
FIG. 2 schematically illustrates the anchor set within the casing below the smaller diameter tubing and a setting tool being removed from the casing through the tubing string.

The expandable anchor A of the present invention is shown schematically in FIG. 1 in unset, running in position and is shown schematically in FIG. 2 in set position in the casing C.

Bow spring centralizers, represented at CD in the drawings may be employed as part of the whipstock tool and in some steps in the method of forming a window, or in other operations, particularly where the load is not so great as to affect the function of the bow spring centralizer. In other situations where the weight is greater, such as with a whipstock tool as shown in FIG. 4, it is desirable to employ centralizers of the form designated CD' which will be described in greater detail hereinafter.

In FIG. 4 the whipstock tool W, by way of example only, is shown secured in the set expandable anchor A.

The anchor A, including the slips and the groups of movable members associated with the anchor must be limited to a maximum outside diameter which will accommodate passage of the anchor and its components through the tubing T to position it within the casing C at the elevation where setting is desired.

Referring to FIG. 1, the anchor A is shown as positioned within the casing C using either an electric wireline or a conventional coupled tubing or continuous coil tubing setting tool which functions to position the anchor A through the small diameter tubing and into the larger diameter casing C and to convey electrical current or hydraulic pressure, respectively, to either the wireline form of setting tool or the hydraulic form of setting tool, referred to generally at WSS or HSS, respectively.

After the anchor A is set in the casing C, the hydraulic setting tool HSS, or the wireline pressure setting tool WSS is actuated which sets or secures the anchor with the casing C and then releases the setting tool from the anchor C, to enable the setting tool to be removed as represented by the arrow 75' from the well as shown in FIG. 2.

Because of the smallness of the size of the internal diameter of the tubing T through which the anchor A is run and the size of the casing C in which the anchor A is to be set, the expandable anchor A outside diameter generally must be so small that it is not generally feasible to provide an opening, or bore extending through the anchor mandrel 1.

The mandrel 1 of the expandable anchor A is shown in one form in FIGS. 8 and 9 as being a solid shaft. Under some circumstances, the size of the tubing T and casing C may be such that the anchor mandrel 1 may be a tubular member with a bore therethrough.

Both the hydraulic setting tool HSS and the wireline setting string WSS may use either a shear stud 5 or a latch 95 to effect release of the setting tool from the anchor mandrel after the anchor A is secured in the larger diameter casing C. One suitable form of shear stud is seen in FIG. 10, and one suitable form of latch is seen in FIGS. 21 and 22. The shear stud form is employed when the anchor mandrel 1 is a solid shaft, and the latch form 95 is employed when the anchor mandrel 1 is a tubular member.

Threadedly connected at 2A to the top expander 8 is a riser 2, as seen in FIGS. 10 and 11. The riser 2 extends upwardly from the top expander 8 and terminates above the mandrel 1 of the anchor A as seen in FIGS. 8, 9 and 10. The top expander 8 is a tubular member having an opening, or bore 8A therethrough which the expandable anchor mandrel 1 slidably moves when the setting tool is actuated to secure the expandable anchor with the larger diameter casing C or tubular member.

The riser 2 has a bore 3 in its upper end portion, better seen in FIG. 8, into which bore 3 the work string mandrel 4 of the setting tool extends as shown in FIG. 10 to connect by means of a shear stud, with the anchor mandrel 1 in larger diameter bore 6 in riser 2, which anchor mandrel extends upwardly from the lower end of the riser 2 as seen in FIG. 8.

The setting mandrel 4 is connected with the lower end of the setting toot and is threadedly connected as shown at 5' in FIG. 10 to shear stud 5 which shear stud in turn is threadedly connected as shown at 5" to the mandrel 1 of the anchor in the bore, or opening 6 in riser 2 as seen in FIGS. 10 and 11.

Shear stud 5, as illustrated in FIG. 10, contains a reduced section 5A between its threaded ends to provide a controlled area which will break under application of a specified tensile load greater than that required to set the anchor A, so that the expandable anchor is first set and then the setting tool and its mandrel 4 and setting sleeve 4A associated with the appropriate setting tool WSS or HSS is then released from the mandrel 1 of the expandable anchor A by the continued residual force applied by the WSS or HSS.

At the upper end portion of the riser 2 is a downwardly facing and downwardly extending biased edge 7 as better seen in FIGS. 8 and 9, which edge is continuously perpendicular to the point of tangency at all points along the biased circumference. The lowermost end of the biased edge 7 terminates in an orientation recess or slot 7A which extends longitudinally downwardly from the lowermost end, or edge, of the biased edge 7, the purposes of which will be explained later. A chamfer 7B, as illustrated in FIGS. 9 and 9A, is located on the outer surface of the side opposite the recess or slot 7A at the top end of the riser 2 and extends downwardly from adjacent the top of the biased edge 7 of the riser 2 as illustrated in FIGS. 9 and 9A. The chamfer 7B facilitates guiding the latch assembly on the assembled whipstock tool to telescopically engage the latch assembly, or arrangement LA with the riser 2 of the set expandable anchor A, as will be more fully explained hereinafter.

An annular latch groove 2B is positioned on the outer circumference of the riser 2 below the orientation slot 7A as shown in FIGS. 8 and 9. The latch groove 2B facilitates latching or locking of the latch assembly LA and associated components of the whipstock tool with the set expandable anchor A as will be discussed later, in detail, along with the latch assembly LA.

An annular recess 8B is formed in the top expander 8, below the threaded connection 2A in which a ratchet ring housing 9 is positioned. The ratchet ring housing 9 has an internal buttress thread as represented at 9A in FIG. 10, the thread depth of which is substantially greater than that of the buttress thread 1A on the mandrel 1 which is spaced below the external buttress thread 9A when the mandrel 1 is in the lowering in position shown in FIG. 10.

A split ratchet ring 11, as illustrated in FIG. 10, has an external buttress thread 11B with a matching profile to that of internal buttress thread 9A of ratchet ring housing 9 and also has an internal buttress thread 11A with a thread profile matching that of buttress thread 1A of the mandrel 1.

When the setting tool is actuated to secure the anchor within the larger diameter tubular member, such as casing, opposing forces in the direction as represented by the arrows 70' and 70, respectively, in FIGS. 10 and 11 are applied through the setting tool mandrel 4 to the anchor mandrel 1, and to the top expander 8, since it is abutted by the setting sleeve 4A of the setting tool WSS or HSS. This causes the anchor mandrel 1 to slide or move up within the annular opening, or longitudinal bore 8A of the top expander 8 and within the opening or bore 6 of the riser 2.

After the slips 21 have been engaged with the casing C by the movable members, or expanders 14 and 19 as will be explained, the buttress thread 11A of ratchet ring 11 engages with the buttress threads 1A of the mandrel 1. This retains the top expander 8 in a locked position relative to the mandrel 1, and causes the expandable anchor A to be locked in secured, or set, position within the casing, or tubular member C.

Threadedly connected adjacent the lower end 1' of the mandrel 1 is a bottom expander 12. The outer peripheral surface of the top expander 8 and the outer peripheral surface of the bottom expander 12 each have a plurality of inclined external curved peripheral surfaces represented generally by 8' and 12', respectively, in FIGS. 10 and 11 which peripheral upper and lower expander surfaces 8' and 12', extend in a predetermined direction.

The inclined external curved surfaces, 8' and 12', are of a continuous uniform radius or curvature throughout each of said plurality of surfaces on each the top expander 8 and the bottom expander 12 rather than being conic sections or conic surfaces. The external curved surfaces 8' on the top expander 8 preferably extend and slope in an upwardly and outwardly direction and the external curved surfaces 12' on the bottom expander 12 preferably extend and slope in a downwardly and outwardly direction as illustrated in FIGS. 10 and 11.

The outwardly and upwardly inclined external curved surfaces 8' of the top expander 8 preferably are adjacent and extend above the upper end 21''' of the slips 21 and the inclined external curved surfaces 12' of the bottom expander 12 are adjacent and extend below the lower end 21" of the slips 21 as seen in FIGS. 10 and 11 when the anchor is assembled.

The number of upper inner movable members, or upper inner expanders, represented at 14 in FIGS. 10, 14 and 15 of the drawings which are contiguous with the external curved surfaces 8' of the top expander 8 is the same as the total number of external inclined curved surfaces 8' on the top expander 8.

The number of lower inner movable members, or lower inner expanders 14, contiguous with the external curved surface 12' of bottom expander 12 is the same as the total number of external inclined curved surfaces 12' on the bottom expander 12.

The number of upper outer movable members 19 is the same as the number of upper inner movable members and the number of lower outer movable members 19 is the same as the number of lower inner movable members 14.

The number of external curved surfaces 8' on the top expander 8 is the same as the number of curved external surfaces 12' on the bottom expander. The number of upper inner and outer movable members, or expanders 14 and 19 is the same as the number of lower inner and outer movable members, or expanders, 14 and 19.

Each of the upper inner movable members, or expanders, 14 is contiguous, respectively, with a curved external inclined surface 8' on top expander 8, and each of the upper inner movable members, or expanders, 14 has an inwardly inclined internal uniform curved surface represented at 14' which conforms with a contiguous external inclined curved surface on 8'.

Each of the lower inner movable members, or expanders 14 is contiguous, respectively, with a curved external inclined surface 12' on bottom expander 12, and each of the lower inner movable members, or expanders, 14 has an inwardly inclined internal uniform curved surface represented at 14' which conforms with a contiguous external inclined curved surface 12' on bottom expander 12.

Each of the upper and lower inner movable members, or expanders, 14 has an external curved surface 14" with a curvature or radius which conforms with the internal curved surface 19' of a contiguous upper and lower outer member 19, as seen in FIG. 15.

The surface extent of the inwardly inclined internal uniform curved surface 14' of the upper and lower inner movable members, or expanders, 14 need not necessarily be same as the surface extent of the contiguous external curved surface 8' and 12', respectively, on the upper and lower inner movable members.

However, the surface extent and thickness of the upper and lower inner and outer movable members, or expanders, 14 and 19 must be of sufficient extent to function for accomplishing the desired results of the present invention and to accommodate the dove tail keys, the limit groove, the dove tail groove on the external surfaces to receive the key on the contiguous member or the slips, limit pin 16 and shear pins when present.

It is preferred that the surface 19' on the outer upper and lower movable members, or expanders, 19 that is contiguous with an inner upper and lower movable member 14 conform generally in size with the contiguous inner upper and lower movable member 14, respectively.

Each of the upper and lower inner movable members, or upper and lower expanders 14 also have at least one permanently affixed dove-tail key 14A, better seen in FIGS. 14 and 15 which key has outwardly angled, or inclined, longitudinally extending edges 14B along and on each side thereof as better seen in FIGS. 14 and 15.

Each of the curved surfaces 8' and 12' contain at least one dove-tail groove 13 extending at least the full length of the outwardly inclined external surfaces 8' and 12'. The groove 13 has inclined longitudinally extending edges 13' that match or conform with the longitudinally extending edges 14B of key 14A to slidably receive the key 14A of the inner upper and lower movable members, or upper and lower expanders, 14 when the inner upper and lower movable members, or expanders 14 are positioned in an outwardly inclined and overlapping relationship with said top and bottom expander members, respectively, as seen in FIGS. 10–15.

In addition to maintaining continuous slideable engagement or contact of the plurality of external curved surfaces 8' and 12' on the top and bottom expanders, respectively, with the contiguous internal curved surfaces 14' on inner upper and lower movable members, or upper and lower expander members 14, engagement of the dove-tail key 14A within the dove-tail groove 13 substantially inhibits, if not completely prevents relative rotation between the top expander 8 and the bottom expander 12 and their respective inner movable members, or expanders, 14.

A limit groove 15 extends along and in the outwardly inclined internal curved surfaces 14' of each of the inner upper and inner lower movable members 14 between a first limit shoulder 15' and a second limit shoulder 15" in the limit groove 15.

A limit pin 16 limits the extent of slideable movement of each of the upper movable members, or upper inner expanders 14, of each group of the upper inner movable members, or upper inner expanders 14, in all forms of the invention in any suitable manner with the top expander 8 , by way of example only, as shown in the FIGS. 11–19 forms by threadedly engaging the limit pin 16 with the contiguous external curved surface 8' of the top expander 8 within the limit groove 15 in the matching contiguous internal curved surface 14' of upper inner movable members or expanders 14 as shown in FIGS. 10 and 11.

Similarly, a limit pin 16 limits the extent of slidable movement of each of the lower inner movable members, or lower inner expanders 14, of each group of the lower inner movable members, or lower inner expanders 14, in all forms of the invention in any suitable manner with the bottom expander 12, by way of example only, as shown in the FIGS. 11–19 forms by threadedly engaging the limit pin 16 with the contiguous external curved surface 12' of the bottom expander 12 within the limit groove 15 of the contiguous matching internal curved surface 14' of the lower inner movable member, or expander 14, as shown in FIGS. 10 and 11.

Figure 17:
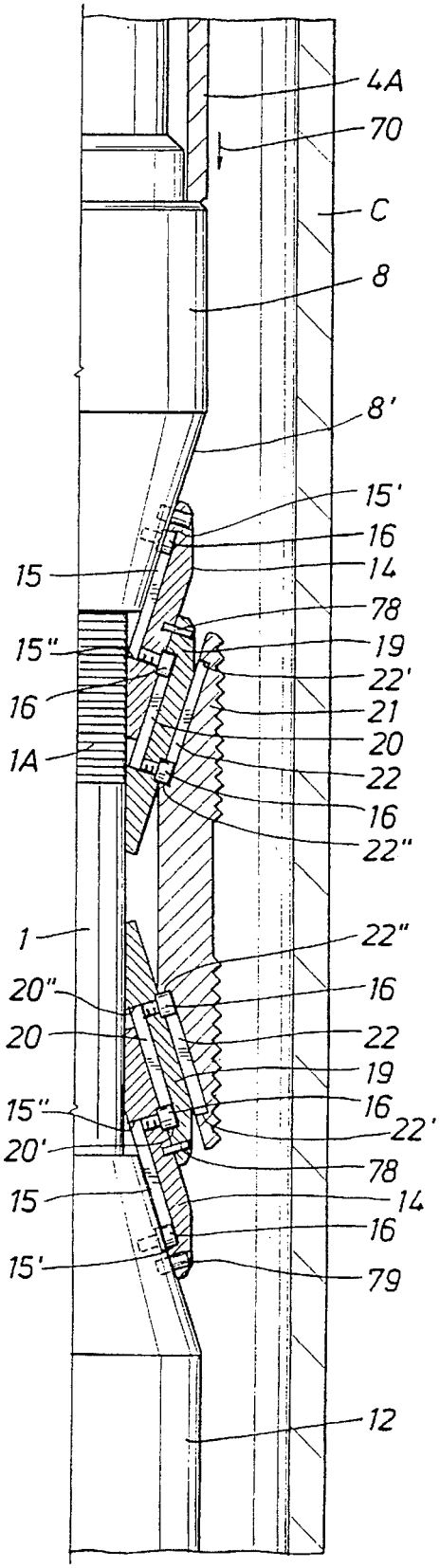

The inner movable members, or expanders, 14 have a thickness which extends circumferentially between the external uniform curved surface 14" and the internal uniform curved surface 14' sufficient to incrementally extend, or move, the outer movable members, or expanders, 19 and the slips 21 toward the inner surface of the casing C upon completion of the first setting sequence as shown in FIGS. 11 and 17.

Outer upper and lower movable members, or expanders, 19, are each positioned in outwardly inclined and overlapped relationship with and between the inner upper and lower movable members, or expanders, 14 and the slips 21, which outer movable upper and lower members, or expanders, 19 are used, as will be explained hereinafter for the purpose of further incremental extension, or movement, of the outer movable members, or expanders, and slips toward contact with the inside surface of the casing C as shown in the completed second setting sequence of FIGS. 12 and 18.

The outer upper and lower movable members, or expanders, 19 each have internal uniform curved surfaces 19' circumferentially spaced from external uniform curved surfaces 19", similar to surfaces 14' and 14", respectively, as described with regard to the inner upper and lower movable members, or expanders 14.

The internal uniform curved surface 19' of each outer upper and lower movable member, or expander, 19 also has a curvature or radius which matches, or conforms with, the external uniform curved surface 14" of the inner upper and lower movable members, or expanders, 14 as shown in FIG. 15.

Figure 12:
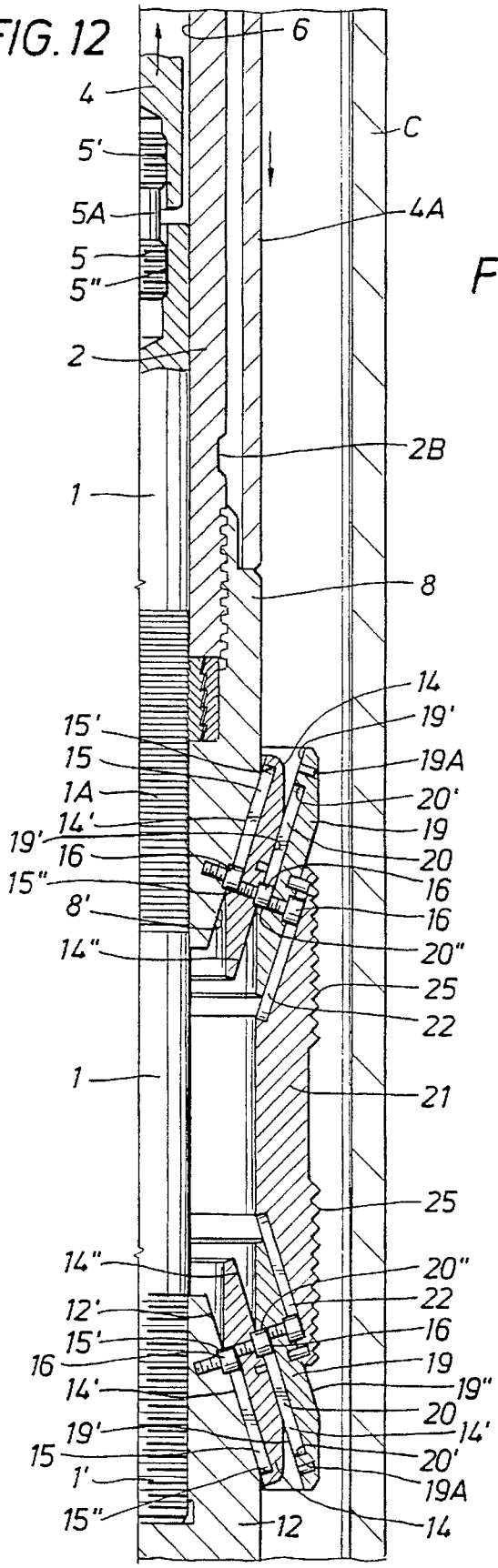
FIG. 12 is a view similar to FIG. 11 illustrating the position of the movable members, or expanders of the anchor after completion of the first and second sequence, or increment, in expanding the anchor by movement of the top and bottom expanders which moves the inner movable members under the outer movable members which moves the slips supported thereon toward the casing.
Figure 18:
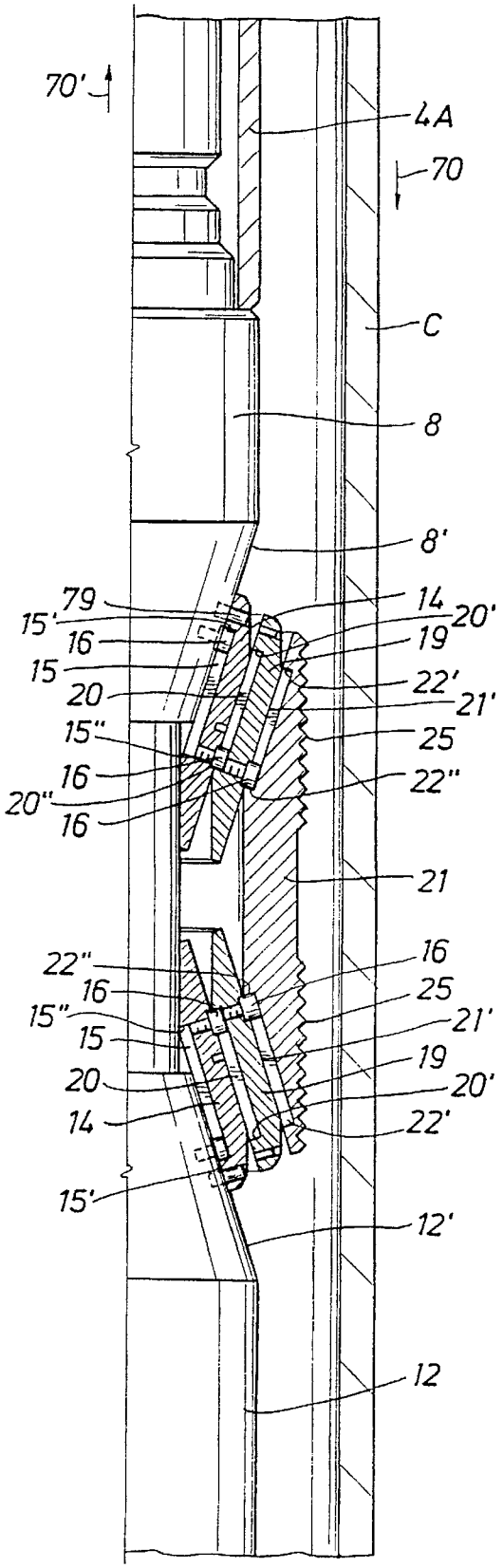
Figure 19:
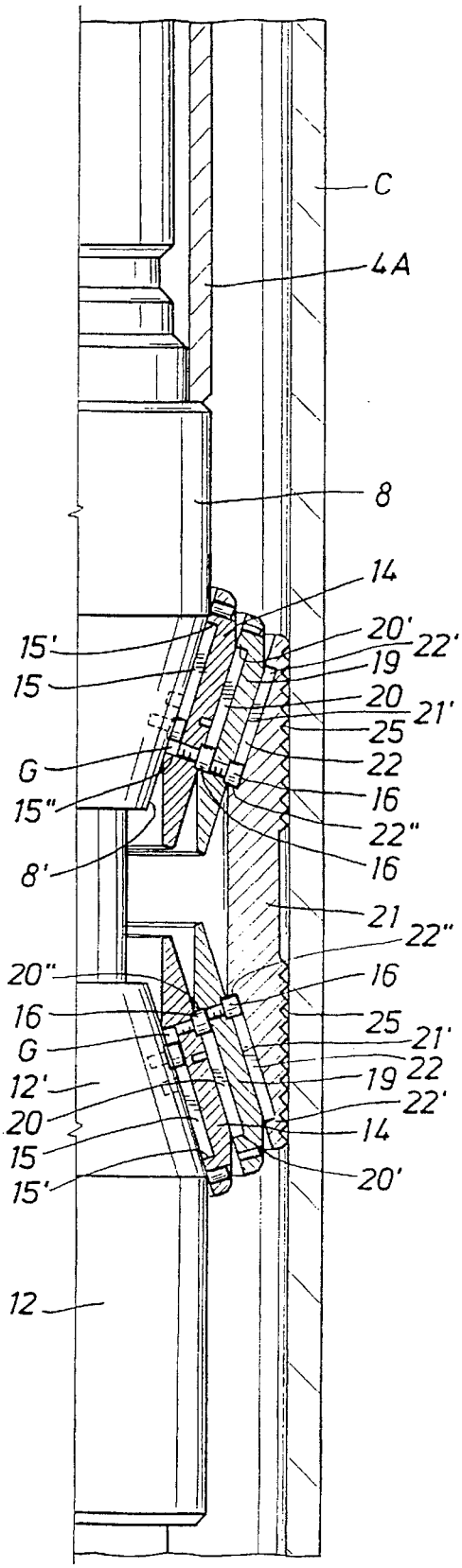

The outer upper and outer lower movable members, or expanders, 19 each have a thickness which extends circumferentially between the external curved uniform surface 19" and the internal uniform curved surface 19' sufficient to further incrementally extend, or move, the outer upper and lower movable members, or expanders, 19 and the slips 21 toward the inner surface of the casing C upon completion of the second setting sequence as shown in FIGS. 12 and 18.

Each of the outer upper and lower movable members, or expanders, 19 as shown in FIG. 15 contain at least one permanently affixed dove-tail key 18 with outwardly angled or inclined edges 18' extending from the internal uniform curved surfaces 19' to engage the at least one dove-tail groove 17, having inclined edges 17' positioned in the external uniform curved surfaces 14" of inner expanders 14 to permit slideable movement between the key 18 and groove 17 while preventing relative rotation therebetween.

A limit groove 20 with a first limit shoulder 20' and second limit shoulder 20" extends along and in the outwardly inclined internal uniform curved surface 19' of each upper and lower outer movable member, or expander 19 for receiving the limit pin 16 which is secured in the inner movable members, or expanders, 14 and extends into limit groove 20 as shown in FIGS. 10 and 11 of the drawings.

The internal uniform curved surface 19' of each of the upper and lower outer movable members, or expanders, 19 have at least one permanently affixed dove tail key 18 with outwardly inclined, longitudinally extending angled edges 18'.

At least one dove-tail groove 17 with inclined edges 17' extends at least the full length of the outwardly inclined external uniform curved surface 14" of the outer upper and lower movable members, or expanders, 14 and cooperates with the permanently affixed dove-tail key 18 in the internal uniform curved surface 19' of each of the upper and lower outer expanders 19 for slideable movement therebetween, while preventing relative rotation therebetween.

At least one dove-tail groove 23 with inclined edges 23' extends at least the full length of the outwardly inclined external uniform curved surface 19" of the outer upper and lower movable members, or expanders 19, and cooperates with the at least one permanently affixed dove-tail key 24 in the curved outwardly inclined internal surfaces 21' adjacent each end of the slips having a radius matching the external uniform curved surface 19" of each of the outer movable members, or expanders, 19 for sliding movement therebetween, while preventing relative rotation there between.

Figure 16:
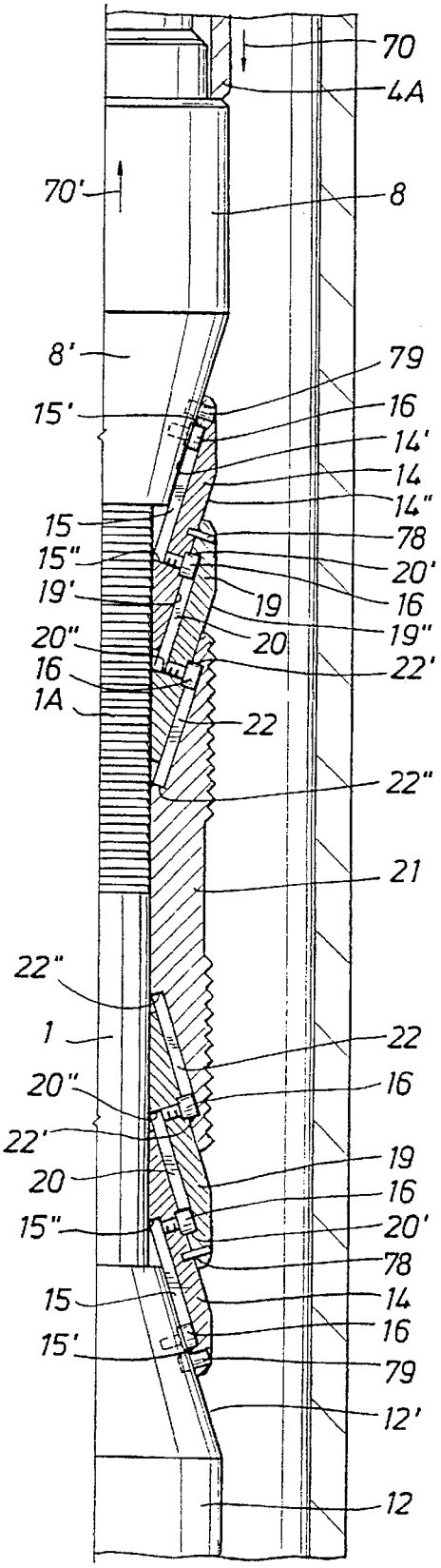
FIGS. 16–19 are views similar to FIGS. 10–13 illustrating one of the many other possible arrangements for sequencing movement of the movable members or expanders of the groups on the expandable anchor from retracted position after moving through smaller diameter tubing to expand and secure slips supported on the movable members in a larger diameter casing or tubular member.

The limit pin 16 that connects the upper and lower inner movable member, or expander, 14 with the top expander 8 and bottom expander 12, respectively, extends outwardly from the top expander 8 and from the bottom expander 12 into the limit groove 15 to engage the first limit shoulder 15' of the limit groove 15 of each contiguous upper and lower inner movable member, or expander 14 as seen in FIGS. 10 and 16 when the expandable anchor A is in an unset position as shown in FIGS. 10 and 16.

The limit pin 16 secured in each inner upper and each inner lower movable member, or expander 14, in the form of the invention shown in FIGS. 10–19, extends into the limit groove 20 in the inner inclined curved surface 19' of the contiguous outer upper and lower movable members, or expanders, 19 and abuts the first groove limit shoulder 20' when the anchor A is in unset position as shown in FIG. 11.

The limit pin 16 secured in the outer upper and the outer lower movable members, or expanders 19, in the forms of the invention shown in FIGS. 10–19 extends into the limit groove 22 extending in the outwardly inclined internal uniform curved surfaces 21' of slips 21 and abuts the first, or upper, groove shoulder 22' when the anchor A is in unset position as shown in FIG. 11.

The limit pins 16 are installed by means of a hole or opening of sufficient size in the movable members 14 to permit through passage of each of the limit pins communicating between the bottom of limit grove 15 and the external curved surface 14" of inner expander members 14. Like communicating passages serving the same function for installing limit pins 16 are positioned at similar locations in both the outer movable members, or outer expanders 19 and the slips 21.

The outwardly inclined internal uniform curved surfaces 21', above referred to, are adjacent each end of the slips 21 and have radii matching the external uniform curved surfaces 19" of the outer expanders 19.

The slips 21, in a number equal to one-half (½) that of the outer expander members 19, have hardened V-shaped wicker teeth 25 on the outside surface, adjacent each end of said slips which engage and partially penetrate the inner surface of the casing C, upon setting of the anchor A, to secure said anchor against longitudinal and rotational movement within the casing C.

At least one permanently affixed dove-tail key 24 extends from the internal surfaces 21' of each of the slips 21. The at least one dove-tail key 24 has outwardly angled, or inclined edges 24' extending longitudinally along and on each side which engage and slide within at least one dovetail groove 23 positioned in the external uniform curved surface 19" of outer upper and lower movable members, or expanders 19 to permit a slideable, but non-rotational relationship between said outer upper and outer lower movable members, or expanders, and the slips 21.

The upper and lower inner movable members, or expanders, 14 each have a limit groove 15 with a first, or upper, limit shoulder 15' and second, or lower, limit shoulder 15". The upper and lower outer movable members, or expanders, 19 each have a limit groove 20 with a first, or upper, limit shoulder 20' and second, or lower, limit shoulder 20". The slips 21 each have a limit groove 22 with a first, or upper, limit shoulder 22' and second, or lower, limit shoulder 22".

The limit grooves 15, 19 and 22 each receive a limit pin 16 which limits the longitudinal movement between the contiguous inner and outer upper and lower movable members, or expanders, 14 and 19 and between the contiguous outer upper and lower outer movable members 19 and the slips 21.

It is preferred that the limit groove in the movable member, or slips which have the largest, or strongest shear pin have limit grooves of sufficient length to provide clearance, or a gap G adjacent the second end to assure that the limit pin 16 will not contact the second shoulder of the last to move component before slips 21 contact the inner surface of the larger diameter tubular member and secure the anchor A. This assures that the movable slips will not be prevented from engaging the larger diameter tubular member, or casing upon movement of the movable members.

Figure 13:
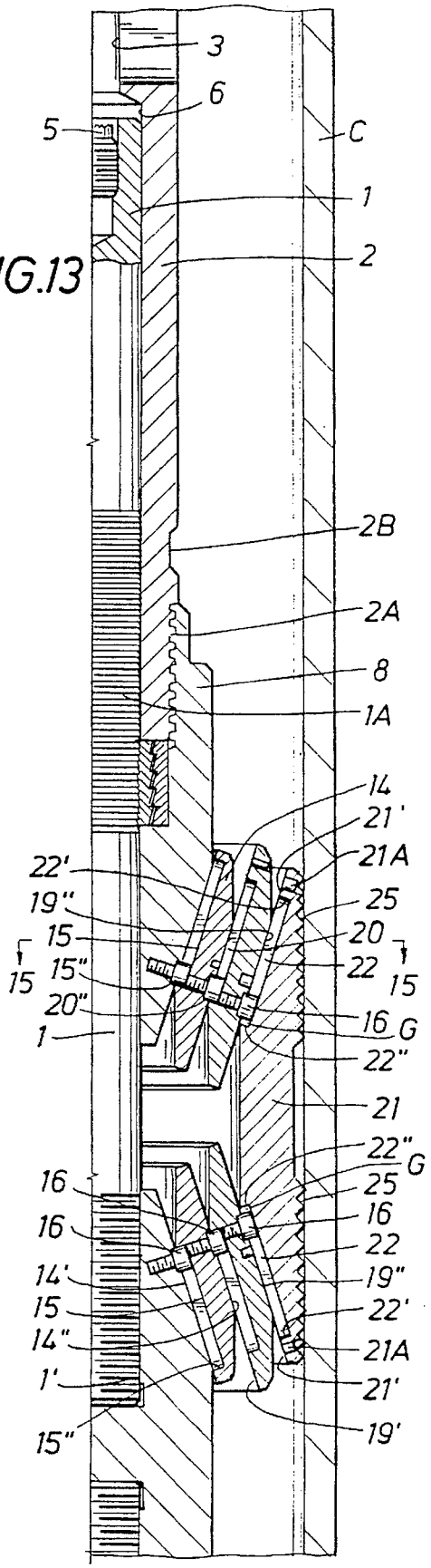
FIG. 13 is a quarter section view similar to FIG. 12 illustrating the position of the anchor and associated components after completion of the first, second and third or final, sequence which sets the slips of the expandable anchor within the casing.

For example in the form of the invention shown in FIGS. 10–13, the space to provide gap G is in limit groove 22 at the second end 22" of the limit groove 22 in the slips 21 in FIG. 13 since the slips have the largest shear pin therein and the slips are the last to be moved.

In the form of the invention shown in FIGS. 16–19, the slips 21 are the first to be moved outwardly since there is no frangible member, such as a shear pin by way of example, connecting the slips with the outer upper movable member, or outer lower movable member, or expander, 19. The largest and strongest shear pin is shear pin 79 which is in inner upper and lower movable member 14 and extends into top expander 8 and bottom expander 12, respectively, and the upper and lower inner movable members 14 are the last to move in the FIGS. 16–19 form of the invention. Thus space for gap G is in limit groove 15 as shown in the drawings.

In the form of the invention shown in FIGS. 10–13, there are no frangible members, such as shear pins by way of example, between the outwardly inclined external uniform curved surface 8' and 12' of the top and bottom expander, respectively, and the inner movable members, or expanders, 14.

In the FIGS. 10–13 form, shear pins 19A of a specified size are shown extending between the external uniform curved surfaces 14" of the inner movable member, or expander member, 14 and the internal uniform curved surface 19' of the outer movable member, or expander member, 19; shear pins 21A, of a larger size and stronger than shear pins 19A, extend between the external uniform curved surface 19" of the outer expander member 19 and the internal uniform curved surface 21' of the slips 21. No shear pins are contained between the outwardly inclined external uniform curved surface 8' and 12' of the top expander member 8 and the bottom expander 12 respectively, and the internal uniform curved surfaces 14' of the inner upper and lower movable members, or expanders 14.

Actuation of the setting tool HSS or WSS applies forces to the top expander 8 and the anchor mandrel 1 as represented by the arrows 70 and 70', respectively, in the FIGS. 10–13 form which cause shear pin 85 extending between anchor mandrel 1 and top expander 8 to break which permits the above mentioned forces to move the anchor mandrel 1 and riser 2 longitudinally relative to each other since the anchor mandrel 1 may now move or telescope upwardly in the annular opening, or passage 6 extending upwardly from the lower end of the riser 2 which movement also moves top expander down.

This initiates the first setting sequence which is to move the top expander 8 and surface 8' thereon and the bottom expander 12 and surface 12' thereon, respectively, under the outwardly inclined internal surfaces 14' of the inner upper and inner lower movable members, or expanders, 14, which causes the upper and lower inner movable members, or expanders 14 to slide outwardly and upwardly and outwardly and downwardly, respectively, as seen in FIGS. 10 and 11 along the uniform curved surfaces 8' and 12' of the top expander and bottom expander, respectively, since there are no frangible members to break between the two elements which would cause resistance.

Since upper and lower outer members 19 and slips 21 are interconnected with the upper inner and outer movable members 14, they move with upper inner and outer movable members 14 during the above movement.

When the limit pins 16 threadedly engaged in the top and bottom expanders 8 and 12 contact second limit shoulder 15" of limit groove 15 in the upper inner and lower movable members 14, relative longitudinal movement between the top and bottom expanders 8 and 12 and the upper and lower inner movable members, or expanders 14, cease as shown in FIG. 11.

Movable members 14 now move with the top and bottom expanders 8 and 12, respectively, in response to the continued application of force from the setting tool.

The continued application of force by the setting tool is transmitted to the upper and lower outer members, or expanders, 19 which shears upper and lower shear pins 19A connected between inner upper and lower inner members, or expanders, 14 and contiguous outer upper and lower members, or expanders 19, respectively. This allows top and bottom expanders 8 and 12 to move further under the upper and lower inner movable members, or expanders 14 which slides the outer upper and lower movable members, or expanders, 19 further outwardly along the mating contiguous inclined uniformly curved external surfaces 14' of upper and lower movable members, or expanders, 14 and uniformly curved internal surfaces 19' of upper and lower outer movable members, or expanders 19 until the limit shoulder 20" contacts limit pin 16 threadedly contained in outer upper and lower movable members, or expanders 19 as shown in the completed second setting sequence of FIG. 12.

The application of continued force from the setting tool is transmitted to the slip means 21 which causes the shear pins 21A extending between the outer upper and lower movable members, or expanders, 19 and the slip means 21 to break, allowing the internal uniform curved surface 21' of slips 21 to move outwardly along contiguous external uniform curved surface 19" of upper and lower outer movable members, or expanders 19, until the teeth 25 of slip means 21 contact and partially penetrate the internal surface of the Casing C as shown in FIG. 13.

The foregoing movement has moved the bottom expander 12 threadedly attached on mandrel 1 and top expander 8 toward each other which aligns the ratchet ring 11, contained within the annular recess 9 of the top expander member 8, with buttress threads 1A on the mandrel 1 to lock the anchor A in a set position within the casing C, after which the continued application of force to the set anchor A breaks the shear stud 5, releasing the setting tool from the anchor A. This completes the third and final setting sequence of the forms of the invention illustrated in the drawings and shown completed with shear stud 5 broken as shown in FIG. 13 and latch 95 released from the anchor mandrel 1 in FIG. 22.

The interconnected upper inner and outer movable members, or expanders, 14 and 19, respectively, and the interconnected lower inner and outer movable members, or expanders, 14 and 19, respectively, with the slips connected therebetween form a plurality of groups of cooperating elements which are secured, or maintained on the anchor A in collapsed, or retracted position for moving with the anchor through the smaller diameter tubing and which elements are expanded or movable outwardly away from the anchor mandrel to expand and secure the slips 21 with the larger diameter tubular member C. The number of groups is the same number as the external curved surfaces on the upper and lower expanders 8 and 12.

The anchor A is constructed and actuated to provide sequential setting of the various elements which is preferred, if not essential, to prevent extreme longitudinal misalignment of the various expanders or slips which could bind or lock the accompanying dove-tail keys within the corresponding dove-tail grooves, preventing proper setting of the anchor A. However, it can be appreciated that the movement of the various elements may not have any substantial time delay or spacing therebetween during the setting sequence.

For example, if a wireline pressure setting assembly is employed as the setting tool, the reaction of the setting tool assembly on various elements may be almost simultaneous with no substantial noticeable time lag between the sequences in view of the rapid action of the wire line pressure setting assembly which is actuated by detonation of an explosive charge in a manner well known in the art.

Where a hydraulic setting tool assembly is employed, the force build up may not be as rapid, and the time lag between sequences may be more noticeable.

The sequential setting pattern or steps of the invention shown in FIGS. 10–13 above described may be changed, or varied as desired and can be accomplished by installation of frangible elements, such as shear-pins having selected strength between the top and bottom expanders and selected movable members or expanders; shear pins between selected movable members, or expanders; shear pins of selected strength between selected movable members and slips and by selective omission of shear pins or varying the arrangement of the shear pins by size among the movable members; top and bottom expanders; and/or the slips.

Any of many variations are possible, such as, by way of example only, a small, or the weakest shear pin between the upper and lower inner movable members and the top expanders 8 and 12, respectively, the largest shear pin between upper and lower movable members 14 and outer upper and lower movable members 19 and no shear pin between the slips 21 and the outer upper and lower movable members 19.

In the form of the invention shown in FIGS. 10 through 13, shear pins 19A of a specified size are shown extending between the external uniform curved surfaces 14" of the inner movable members, or expanders 14 and the internal uniform curved surface 19" of the outer expanders 19. Shear pins 21A, of a larger size and stronger than shear pins 19A, extend between the external uniform curved surface 19" of the outer expanders 19 and the internal uniform curved surface 21' of the slips 21.

FIGS. 16–19 illustrate one variation, by way of example only, for the arrangement of the shear pins. Like numerals of similar components previously described with regard to the previous Figures are used with these Figures.

FIG. 16 has no shear pin between between the slips 21 and outer member 19 so that the slips 21 will first move outwardly when the work string is actuated. The smallest, or weakest, shear pin is shown at 78 between the inner movable members, or expanders, 14 and outer movable members, or expanders 19, and will shear first. The largest and strongest shear pin 79 is between the upper and lower inner movable members, or expanders, 14 and the top and bottom expanders 8 and 12, respectively, and will shear last. In this illustration the slips 21 move outwardly first and then the movable member 19 and then last the movable member 14.

It can be appreciated that if additional movable members, or expanders, are used, other than the single inner and outer upper and lower movable members, or expanders, 14 and 19, respectively, as shown in FIGS. 10–13, the number of possible operable variations becomes substantial.

In the FIGS. 16–19 form, the functions to move the slips 21 outwardly away from the collapsed position adjacent the anchor mandrel 1 to secure with the casing C are generally similar to that described with regard to FIGS. 10–13, but the slips are moved first since there are no frangible members between the slips and the contiguous outer upper and lower movable members, or expanders 19. The upper and lower outer movable members 19 next move, and then the upper and lower inner movable members 14 move last.

FIGS. 20 and 21 illustrate suitable forms of the hydraulic setting tool and a wireline pressure actuated setting tool respectively, either of which may be employed with a mandrel that is a solid shaft, or a mandrel that has a longitudinal bore there through.

In FIGS. 20 and 21 the setting sleeve which is supported on the setting tool is shown at 4A. A piston 60 connected on, or forming part of the setting tool is positioned within the setting sleeve 4A in the FIG. 20 form. The piston 60 includes an extension 61A which is connected with the shear stud 5 as previously described.

Suitable seals S are provided to maintain fluid integrity as shown between the piston and the setting sleeve and between the extension 61A and the setting tool.

Hydraulic fluid is conducted through the bore 62 of the setting tool and discharged through passage 63 underneath piston 60 to urge it and the setting tool upwardly as represented by the arrow 70' in the drawings to act to shear pin 85 to release the mandrel and the top expander 8 for relative longitudinal movement.

Continued application of force by the setting tool as previously described shears shear pins, selectively arranged between the inner and outer movable members, or expanders, and the shear pins between the upper and lower outer members and the slips.

After the movable members, or expanders 14 and 19 and the slips 20 have been moved so that slips 21 are moved outwardly sufficiently to secure teeth 25 with the inner wall of casing C as shown in FIGS. 10–13, the same force continues to act underneath the piston 60 and breaks shear stud 5 to release the hydraulic setting tool HSS from the mandrel 1 for removal of the work string along with the setting sleeve 4A from the well bore.

In FIG. 21 a wireline pressure seting tool WSS with a setting in sleeve 4A is schematically illustrated The projections 81B on longitudinally extending members 81A of a latch 95 fit in annular anchor recess 81 in the mandrel 1. The latch 95 is secured on the member 47A of the setting tool and when the wireline setting tool is actuated in a manner well known in the art, the force first acts to move the movable members relative to the anchor, such movement first occurring where there is no shear pin and then the weakest to the strongest shear pin will shear in that order, as previously described.

The shear pin 48B is stronger than any of the shear pins in the expandable anchor and will shear last. When it shears due to the continued application of force by the setting tool, the member 47 moves up which shears the shear pin 48 and the remaining force of the wireline pressure setting tool will withdraw the latch 95 from the anchor mandrel 1 as illustrated in FIG. 22 and thereby enables the setting tool, the setting tool mandrel 4 along with the setting sleeve 4A to be withdrawn from the well bore.

The setting tool mandrel 4 is connected with the lower end of the setting tool HSS or WSS and is threadedly connected to shear stud 5 which shear stud in turn is threadedly connected as described with regard to the FIGS. 10–13 form to the upper end portion of the mandrel 1.

As described with regard to the FIGS. 10–13 form, shear stud 5 contains a reduced section between its threaded ends to provide a controlled area which will break under application of a specified tensile load greater than that required to set the anchor A, so that the expandable anchor is first set and then the setting tool and its mandrel 4 and setting sleeve 4A associated with the appropriate setting tool WSS or HSS is then released from the mandrel 1 of the expandable anchor A by the continued residual pressure applied by the WSS or HSS. It should also be noted that the anchor A will, in many instances, be set in casing strings which are highly deviated from a vertical position so that the anchor A will have a tendency to contact the low or bottom side of the casing C prior to being set.

The weight of the unset anchor A and the setting tool HSS or WSS would have to be lifted by the movable members or expanders to an approximately centered position within the casing C during the setting operation. Since more force will thus be expended to "center and set" as opposed to only "setting", and since the force available to set the anchor A, particularly in respect to the wireline setting tool WSS which is capable of generating only limited force which would be better expended only in setting the anchor A, both the anchor A and the appropriate setting tool either HSS or WSS are equipped with bow spring centralizers which will deflect sufficiently to pass through the tubing string T as well as maintain said anchor and setting tool in a centered position within the casing C prior to and during the setting operation.

Bow spring centralizers CD, which are well known in the art, are schematically shown attached to the setting tool WSS or HSS in FIG. 1 and bow spring centralizers CD are schematically shown attached with the survey mechanism represented generally at 68 to be lowered on a cable as shown in FIG. 3 during the survey operation. Similar bow spring centralizers CD are shown generally and schematically, in FIGS. 1–4, affixed to a mandrel extension 26' which is threadedly attached to and depend from the bottom of bottom expander 12 as seen in FIGS. 1–4.

The use of the centralizers CD to center the anchor and setting tool within the casing prior to and during the setting operation effectively minimizes the force which might otherwise be required to properly center and set the anchor A. In some instances, centralizers may not be required.

After the anchor A is set within the casing C and the setting tool, HSS or WSS, released from the anchor A and pulled from the well, a survey is conducted, by methods well known in the art and as schematically shown in FIG. 3.

FIG. 3 schematically illustrates a mechanism, or instrument, well known in the art for lowering into a cased well bore on a wireline as shown to conduct and record a survey that determines the orientation, or direction, of a surface relative to a predetermined direction, such as magnetic North, in a well bore.

A survey instrument is schematically represented at 68 in FIG. 3 with a bow spring centralizer CD thereon shown lowered into the casing C. The survey instrument includes a housing 67 with a pin or lug 69 extending into the bore of the housing. The lug 69 is received in the orientation slot 7A of the riser 2 of anchor A when the survey instrument housing is lowered on a cable or any suitable lowering device well known in the art and telescoped over the riser 2 as shown schematically in FIG. 3.

This enables the survey tool to determine either the azimuth of the orientation slot 7A in the riser 2 or the radial location of the orientation slot 7A relative to high side or top side of the casing C. The apparatus and method of obtaining the survey is well known to those skilled in the art, and no detailed explanation is deemed necessary.

Figure 7:
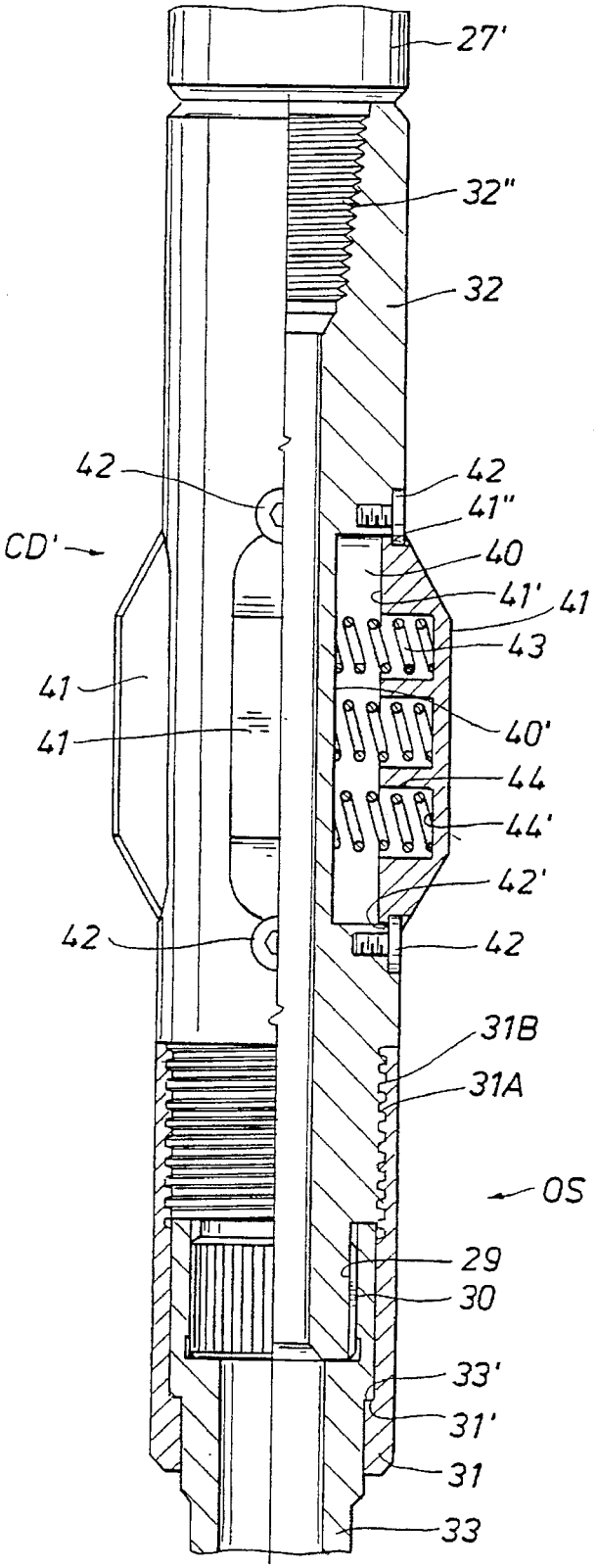
FIG. 7 is a partial sectional view of the centering device CD' tool sub which supports the whipstock sub, and shows in partial quarter section details of the centering device CD' and shows in half section at the lower end of FIG. 7 the orienting mandrel portion of the latch assembly that is connected to the upper end of the latch housing shown in FIG. 9.

The orientation sub, represented generally as OS, in FIGS. 4 and 7, contains a set of orientation splines 29 and 30 which permit incremental adjustment between the splines on the latch mandrel 33 and the splines on the centering device CD' to enable the whipstock face 27" to be directed in a desired azimuth or direction when the orientation lug 28 of the latch assembly LA is engaged in the slot 7A of the riser 2.

Referring to FIG. 7 the orientation splines consist of external splines 29 arranged around the outer circumference adjacent the bottom end of the centering device body 32 and are slideably engaged with mating internal splines 30 arranged around and on the internal circumference of the annular portion at the top end of the orientation mandrel 33, as shown in FIG. 7.

The external splines 29 and the internal splines 30 are retained in engaged position by abutment of the retaining shoulder 33' of the orientation mandrel 33 with the retaining shoulder 31' of the retaining sleeve 31, which retaining sleeve is threadedly connected by threads 31A thereon to threads 31B of the centering device body 32.

In order to adjust between the whipstock face 27" and the orientation lug 28 of the latch assembly LA, it is necessary to threadedly disconnect the threads 31A and 31B to enable the retainer sleeve 31 to be removed from the centering device body 32 at the thread connection 31A. The internal splines 30 of the orientation mandrel 33 can then be slideably disengaged from the external splines 29 of the centering device body 32.

After the splines 29 and 30 are disengaged, the orientation mandrel 33 may be rotated relative to the centering device body 32 to obtain the desired radial spacing between the orientation lug 28 of the latch assembly LA and the whipstock face 27" in light of the information obtained from the survey instrument.

The splines 29 and 30 may then be re-engaged and the retainer sleeve 31 threadedly connected to the centering device sub 32 to establish and maintain an engaged relationship between said external splines 29 and said internal splines 30 and to reconnect the orienting sub OS with the centering device CD' and hinge assembly H which is connected with the whipstock to position the whipstock face 27" relative to the orientation lug or key 28 of the latch assembly LA when the assembled whipstock tool is lowered through the tubing T and into the set anchor A to engage the lug 28 in the orientation slot 7A.

The foregoing arrangement and method enables the whipstock to be adjusted at the earth's surface to face in any desired direction, or manner, when it is positioned in the anchor A of the present invention in the well bore casing to enable the casing to be milled or cut to form a window without removing the smaller diameter tubing from the casing.

The tool to be set in the anchor is assembled at the earth's surface.

Since the whipstock W is connected to the orienting sub OS by the hinge assembly H, the whipstock face 27" will be positioned, or oriented in the desired direction, or manner in which it is desired to form the window when it is lowered into the anchor A to engage lug 28 on latch body 34 with the biased edge 7 on the riser 2 which guides the lug 28 into slot 7A of the riser 2 as the whipstock tool is lowered in the casing on the work string as shown in FIGS. 8 and 9 of the drawings and which positions the whipstock face 27" in a desired direction in the casing C as illustrated in FIG. 4.

The form of whipstock tool shown and described herein is assembled by threadedly connecting the upper end of the body 34 of the latch assembly LA as shown at the upper end of FIG. 9 with the threads 33A on the the lower end of the orienting mandrel 33 as seen at the lower end of FIG. 7. The orientation sub OS which supports the mandrel 33 is connected with the centering device CD' in any suitable manner such as by threads, and the centering device CD' is threadedly connected at 32" to the whipstock sub 27' as better seen in FIG. 7.

Whipstock W is connected at its bottom end 45' by the hinge link 48 of the hinge H in a manner as will be described in detail hereinafter. As previously stated, the foregoing connections are made at the earth's surface to form the whipstock tool.

The latch assembly, or arrangement LA, in the preferred form includes a tubular body 34 whose upper end is threadedly connected to the bottom of the orientation mandrel 33 as shown in FIG. 9. The bottom of the orientation mandrel 33 with which the upper end 33A of the latch assembly is connected is shown at the lower end of FIG. 7 and schematically in FIG. 4.

The orientation lug 28 is permanently affixed to the tubular body 34 of the latch assembly and extends into the bore 34' of the latch assembly tubular body 34 as seen in FIGS. 8 and 9 and aligns and engages a tool, such as the whipstock tool arrangement W above referred to with the orientation slot 7A of the riser 2 of the set anchor A to face the whipstock in the desired direction to accomplish a desired result, which in the example explained herein is to drill, cut or form a window in the casing C.

The latch assembly LA, as the whipstock W is lowered into the casing on a workstring WS, engages the lug 28 of the latch assembly with the riser 2. Continued lowering of the whipstock W secures the latch assembly with the anchor A to face and maintain the whipstock facing in a desired direction to form a window in a desired direction in the casing without first removing the tubing string T from the casing C, as will be explained hereinafter.

The form of latch assembly LA used by way of example herein includes a latch housing 35 as shown in FIG. 8 which is threadedly attached as shown at 34A in FIGS. 8 and 9 with the tubular body 34 and the latch housing has an annular recess 35' shown in FIG. 8 for containment of the latch 36 shown in FIGS. 8 and 9.

The latch 36 of the latch assembly includes circumferentially spaced finger-like extensions 37 as shown in FIGS. 8 and 9 with internally and annularly extending projections 37' at their lower ends. These finger-like extensions 37 flex outwardly into the annular recess 35' shown in FIGS. 8 and 9 as the latch housing 35 of the latch assembly LA is telescopically engaged with the riser 2 of the anchor A, as shown in FIG. 8.

When the orientation lug 28 on the latch body 34 makes contact with the downwardly extending biased edge 7 on the riser 2, with the latch assembly LA as part of the tool arrangement being lowered relative to the riser 2, the engagement of orientation lug 28 with the edge 7 perpendicular at each continuing point of tangency on the upper end of the riser 2, rotates the latch assembly LA until the orientation lug 28 engages the orientation slot 7A which properly orients or positions the whipstock face in the desired direction. Upon full engagement of the latch assembly LA with the riser 2, as shown in FIG. 9, said internal annular extrusions 37' align adjacent latch groove 2B of the riser 2 permitting the finger-like projections 37 of latch 36 to flex inwardly, causing the internal annular extrusions 37' to engage said riser latch groove 2B.

The latch 36 has a series of longitudinal slots 38 above finger-like projections 37 through which frangible members, such shear pins 38A, as shown in FIGS. 8 and 9, extend from a point of attachment to the latch housing 35. The shear pins 38A abut the lower end 38" of slots 38 during engagement of the latch assembly LA on the riser 2, as shown in FIG. 8.

After the internal annular extrusions 37' of the latch 36 engage the latch groove 2B of the riser 2, any upward movement of the combined whipstock W, centering device CD, orientation sub OS, and latch assembly LA will cause the latch to slide within the latch housing 35 until shear pins 38A abut the top end 38' of the longitudinal slots 38, as shown in FIG. 9.

When this occurs, the annular surface portions 35" adjacent the lower end of the latch housing 35 will align with the ends of the finger-like projections 37 that are in the annular groove 2B to retain the internal annular extrusions 37" within the latch groove 2B, effectively locking the latch assembly LA and the balance of the components of the whipstock tool W to the anchor A.

The latch housing 35 has at its lower end 39, an inwardly and upwardly facing bevel 39' to facilitate abutting engagement with the matching surface 8' on the upper expander 8 when the latch arrangement is run in to its lowermost position as shown in doted line in FIG. 9.

As previously stated, the casing C in which the anchor A is set, may be highly deviated from a vertical position and in such cases, the latch assembly LA will, in the process of engaging the riser 2, ride or move along the low side of the casing C which is opposite the face of the whipstock.

Since the riser 2 of anchor A is generally centered in the casing C, the bevel 39' on the lower end of the latch housing 35 will enable the latch assembly LA to engage the tapered chamfer 7B on the upper end of the riser 2 and thereby be lifted from the low side of the casing which is opposite the face of the whipstock represented at 27" in FIG. 4, if necessary, and align to telescope, or move longitudinally over the riser 2.

The alignment above referred to occurs when the bevel 39' on the lower end of latch housing 35, shown in FIG. 8, contacts either the biased edge 7 or the chamfer 7B on the upper outer surface of the riser 2, as shown in FIG. 9A depending upon the rotational position of the orientation slot 7A of the anchor riser 2 within the casing C.

Where too great a difference exists between the tubing T size and the casing C size, the form of lifting or centering devices represented by CD' may need to be employed to lift the latch assembly from the low side of the casing C for alignment to engage with the anchor riser 2 in an manner as previously described.

One suitable form of centering device, in the form of bow springs, shown generally at CD' in FIGS. 4, 5, 6, and 7, may be employed to lift or partially center the lower end of the latch assembly LA when the whipstock tool, by way of example only, is lowered for engagement with the anchor riser 2.

The outside diameter of the centering device CD' must be of a size which will permit its passage through the tubing T into the casing C and still have capacity to lift the lower end of the latch assembly LA in the direction of the center of the casing C.

The form of the centering device CD', described herein and shown in FIG. 7, by way of example only, has a plurality of longitudinal sockets 40 into which centering blocks 41 are fitted and retained by suitable retainers, such as retainer screws 42, threadedly contained in the body 32 at each end of said longitudinal sockets 40. The retaining screws 42 have heads 42' which contact retaining shoulders 41", of the centering blocks 41, to retain the centering blocks 41 within the longitudinal sockets 40. The longitudinal sockets 40 are of sufficient depth in the body 32 to fully receive the centering blocks 41.

The centering blocks 41 have at least one circular socket 44 extending from the inner surface 41' of the centering blocks for positioning coil compression springs 43 which are contained between the bottom 44' of said sockets 44 and the bottom 40' of said longitudinal sockets 40.

The compression springs 43 urge the centering blocks 41 outward from the longitudinal sockets 40 until retained by engagement with retaining screws 42, to raise the centering device CD', and thus the latch assembly LA, from the low side C" of the casing C, which is opposite the face of the whipstock.

Compression of the compression springs 43 also permit the centering blocks to collapse or engage the longitudinal sockets 40 of the body 32 sufficiently to allow passage of the centering device CD' through the smaller internal diameter tubing T into the casing C.

Figure 4A:
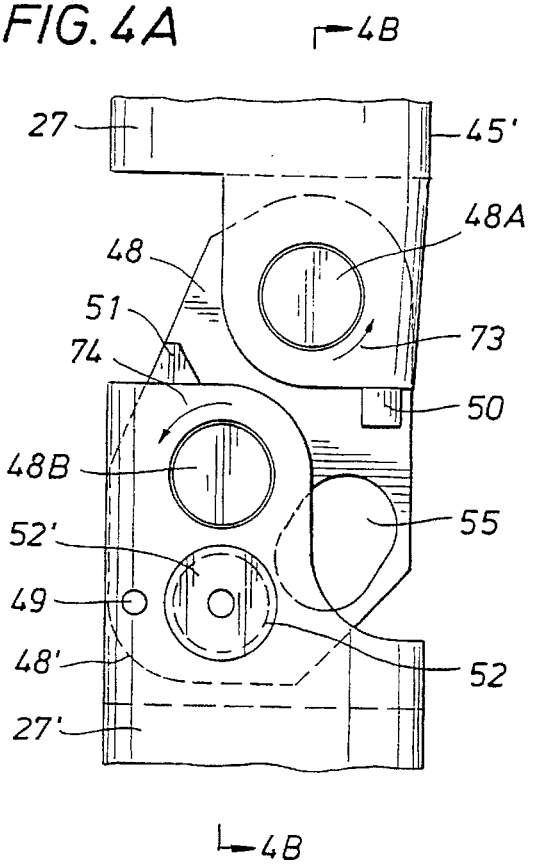
FIG. 4A is a side elevation of the hinge assembly which in one form of the invention is between the whipstock and a form of a centering device used with the whipstock tool as shown in FIG. 4.
Figure 4B:
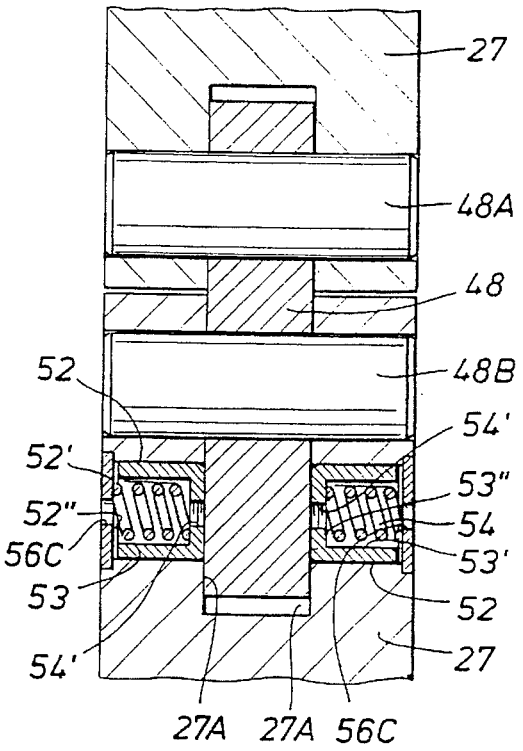
FIG. 4B is a cross section view on the line 4B—4B of FIG. 4A, illustrating details of the whipstock hinge assembly in the unset position in the casing.
Figure 5A:
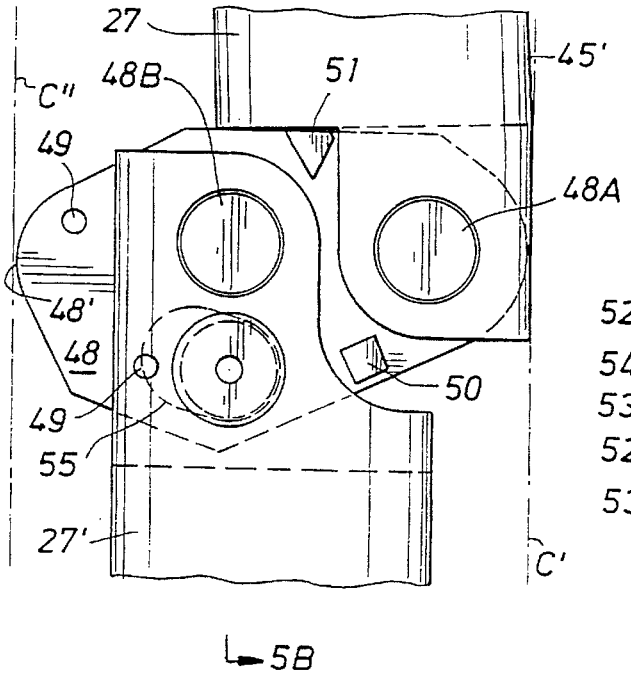
FIG. 5A is a side elevation of the hinge assembly when the whipstock and hinge are each in set position in the casing.
Figure 5B:
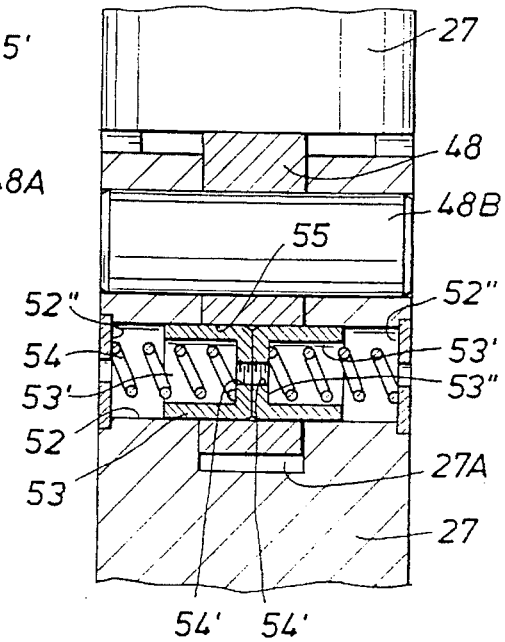
FIG. 5B is a partial cross section view on the line 5B—5B of FIG. 5A, illustrating details of the hinge assembly when the whipstock is in the set position.
Figure 5:
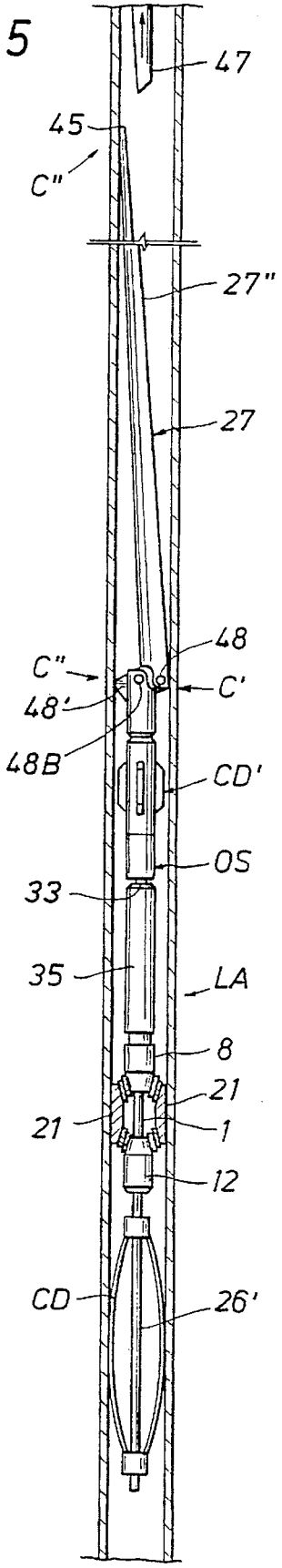
FIG. 5 schematically illustrates the whipstock tool arrangement in set position and released from the whipstock setting tool.

A suitable form of whipstock, by way of example only, is shown schematically and generally at W, in FIGS. 4, 5, and 6 which may be employed in the whipstock tool, or tool arrangement when it is to be used, by way of example only, as a tool for forming a window in the casing C by passing it through the smaller diameter tubing and then into the large diameter casing to position it in the anchor A for cutting a window in the casing C.

All of the elements of the through tubing whipstock W in the example as explained herein, including the anchor A, the latch assembly LA which is threadedly connected to the orienting mandrel 33, which mandrel is supported by the centering device CD', as shown at the lower end of FIG. 7, the centering device CD', whipstock sub 27', hinge assembly H and whipstock must have an outside diameter to accommodate their passage through the smaller internal diameter of the tubing T.

If no centering device is employed, the orienting sub OS including the orienting mandrel 33 associated therewith with the latch assembly LA connected to the lower end thereof may be connected at its upper end of the orienting sub with whipstock sub 27'. In this event, the whipstock sub 27' is provided with external splines 29 for receiving the internal splines 30 on the orienting mandrel 33 in a manner as described with regard to FIG. 7.

The whipstock body 27 is a circular member having an inclined concave face 27" which extends from the whipstock thinnest point at its top end 45, to the whipstock's bottom end 45' where said inclined concave face 27" terminates in the full diameter of the whipstock body as represented in FIGS. 4 and 6.

The concave face 27" of the whipstock body 27 is of a radius somewhat larger than that of the mill 57 which is used to mill the window in the casing C.

The whipstock W is releasably connected to the whipstock workstring member 47, by any suitable means known to those skilled in the art and a frangible shear stud 47' is illustrated by way of example. The whipstock workstring member 47 as shown in FIG. 4 schematically, is connected adjacent the lower end of the workstring WS.

The whipstock workstring member 47 has a convex face matching that of the concave whipstock face 27" at its point of attachment to whipstock 27, all as shown schematically in FIG. 4. Also, as seen in FIG. 4 the whipstock W has a weight distribution shoulder 47" which abuts the top, or upper end 45 of the whipstock body 27 to prevent premature shearing of the shear stud 47' by downward force as the latch assembly LA engages the riser 2.

The hinge assembly H connects the whipstock body 27 to the whipstock sub 27'. The whipstock sub 27' is threadedly connected as represented at 32" with the centering device body 32, as previously described.

The hinge assembly includes a link 48, of sufficient length to extend between the whipstock body hinge pin 48A and the sub hinge pin 48B on whipstock sub 27' to pivot the bottom end 45' of the whipstock body 27 to position the face of the whipstock to face adjacent the casing in the direction of the window to be formed in the casing C as represented at C' in FIG. 5.

When the hinge assembly H is in the unset or running in position as shown in FIGS. 4A and 4B of the drawings, the body hinge pin 48A and the whipstock sub hinge pin 48B of the the hinge assembly H are offset in opposite directions from the centerline of the whipstock 27 as seen in FIG. 4.

Upon application of weight by the whipstock workstring WS, after the latch assembly LA has telescoped over the riser 2, the link 48 pivots about the hinge pins as the whipstock body 27 moves downward, relative to the whipstock sub 27', to break shear pin 49 which is between link 48 and bottom sub 27". This enables link 48 to pivot from the position shown in FIG. 4A to the position shown in FIG. 5A which positions the lower end of the whipstock face 27' to position the face of the whipstock adjacent the casing C in the direction of the window to be formed in the casing side C', as shown in the set position in FIG. 6.

The foregoing action also positions the heel end 48', as seen in FIG. 5A of the hinge 48 adjacent the casing opposite the location of the window to be formed in the casing C to support the whipstock W in the set position as shown in FIG. 6, and the hinge assembly assumes the position shown in FIGS. 5A and 5B when the whipstock tool has been set.

Attached to the link 48 is at least one body anti-pivot key 50, as seen in FIG. 4A, and at least one sub anti-pivot key 51 which prevent the whipstock body 27 and the whipstock sub 27' from pivoting about the body hinge pin 48A and the sub hinge pin 48B, respectively, in any rotational direction other than that shown by the respective arrows 73 and 74 in FIG. 4A.

As better seen in FIGS. 4B and 5B, the whipstock sub 27' also contains at least one aperture 52 covered by a washer 52' which is secured to the whipstock sub 27' by any suitable means. The aperture 52 extends into the link slot 27A of the whipstock sub 27'. Slideably positioned within said aperture is a pair of shot pins 53, each of which contain a spring socket 53'. A compression coil spring 54 is installed and compressed between the inside surface 52" of washers 52' and the bottom end 53" of spring socket 53' and urges shot pin 53 in the direction of the link slot 27A.

When the hinge assembly H is in the unset position, as shown in FIGS. 4A and 4B, the link 48 is positioned adjacent the aperture 52 to maintain the shot pin 52 and compressed coil spring 54 within said aperture 52.

When the hinge assembly H pivots to the set position, as shown in FIGS. 5A and 5B, a locking socket 55 in the side of the link 48 is positioned adjacent the aperture 52, permitting the coil spring 54 to de-compress or expand, urging the shot pin 53 into the locking slot 55 of the link 48.

This locks the whipstock in the set position as shown in FIG. 5 with the top end 45 of the whipstock body 27 against the inside of the casing represented at C" in FIG. 5, opposite the face of the whipstock, and the bottom end 45' of the whipstock body 27 against the inside of the side C' of the casing C adjacent the casing where the window is to be formed, also as shown schematically in FIG. 5.

With the whipstock W locked in the set position, tension may be applied to the workstring WS to shear the whipstock stud 47' and release the whipstock setting tool 47 from the whipstock W as shown in FIG. 5 for removal from the well.

The washer 52' may be provided with an access opening 56C as shown in FIG. 4B through which a screw or bolt (not shown) may be extended to engage the threads 54' in each shot pin 53 to lock the assembled arrangement in the position shown in FIG. 4B when assembled to inhibit premature actuation by inadvertent movement of hinge 48. Premature actuation would require disassembly and reassembly at job site, thus delaying operations.

The whipstock workstring WS, its associated member 47 and whipstock are removed from the well. A mill 57 and, when the work string is coil tubing, a down hole motor of a form well known to those skilled in the art is attached to the workstring WS at the earth's surface and the workstring is then run into the well to the proximity of the whipstock W.

The mill 57 is rotated and lowered, engaging the face of the whipstock W to direct the mill 57 to engage the inside wall of the casing C to mill a window by methods well known in the art, as schematically shown in FIG. 6.

FIG. 23 shows another arrangement wherein the mill is supported by the whipstock workstring WS and the mill is releasably connected to the whipstock by frangible member 51A. In this form, the whipstock workstring is not removed from the casing to add the mill, and tension or weight, preferably tension is applied to the whipstock workstring after positioning it in the casing to break the frangible member 51A which releases the mill to move along the whipstock face to rotate against the casing to form the window.

From the foregoing description, it can be appreciated that the anchor A may be considered as having inner and outer cooperating members. The anchor mandrel 1 with the lower expander secured thereon may be considered an inner member. The riser which is secured to the upper expander which telescopically receives the mandrel may be considered as an outer member.

The movable upper and lower members, or expanders, supported by the top and bottom expander, respectively, with the movable slips secured to and extending between and secured with the upper and lower radially movable members, or expanders, may be considered as an interconnection between the inner and outer member of the anchor A, as above defined, which cooperate to maintain the upper and lower movable members, or expanders, and slips in retracted position to enable the anchor A and slips 21 supported thereon to be lowered on awork stringto pass through a restricted, or smaller diameter tubing and into a larger diameter tubular member.

When the setting tool is actuated, the resulting forces represented by the arrow 70' acting on the inner member and the arrow 70 on the outer member effect outward movement of the upper and lower movable members, or expanders, and the slips secured therebetween radially away from and relative to the anchor mandrel 1 to engage the larger diameter casing and secure the anchor therein.

The mandrel 1 could be furnished, in certain sizes, as a tubular member with a bore therethrough. The configuration of the whipstock may vary depending upon various factors, including, but not limited to, the tubing size it must pass through, the size of casing in which a window is to be formed and the angle between the face of the whipstock and casing internal diameter at the point where the window is to be cut.

The foregoing disclosure and description of the invention are illustrative and explanatory thereof, and various changes in size, shape and material as well as in details of the illustrated construction may be made without departing from the spirit of the invention.

What is claimed is:

1. A method of setting an expandable anchor within a casing at a position below a tubing having a smaller internal diameter than the casing, the method comprising:

releasably connecting an anchor mandrel with a setting tool;

releasably supporting a top expander on the anchor mandrel;

supporting a bottom expander on the anchor mandrel;

movably positioning a plurality of upper members supported on the top expander;

movably positioning a plurality of lower members supported on the bottom expander;

movably positioning a plurality of slips on the upper and lower members for engaging the casing to secure the expandable anchor to the casing; and lowering the expandable anchor through the tubing and thereafter setting the expandable anchor within the casing at a position below the small diameter tubing.

2. The method as defined in claim 1, further comprising:

providing a plurality of inclined external uniform curved peripheral surfaces on the top expander and the bottom expander, each peripheral surface having a continuous curvature along an axial length of each peripheral surface.

3. The method as defined in claim 2, further comprising:

forming the plurality of inclined external surfaces on the top expander and the bottom expander to the have the same continuous radius of curvature.

4. The method as defined in claim 2, further comprising:

providing an inclined internal uniform curved surface on each of the plurality of lower members which conforms with the continuous external curved surface on the bottom expander; and providing an inclined internal uniform curved surface on each of the plurality of upper members which conforms with the continuous external curved surface on the top expander.

5. The method as defined in claim 2, further comprising:

interconnecting the external uniform curved peripheral surface on the bottom expander with one of the plurality of lower members to limit radial movement between the one of the plurality of lower members and the bottom expander.

6. The method as defined in claim 1, further comprising:

providing a frangible member between the plurality of slips and at least one of the top expander and the bottom expander; and shearing the frangible member to allow movement of the plurality of slips to secure the expandable anchor to the casing.

7. The method as defined in claim 1, further comprising:

providing a frangible member between at least one of the plurality of upper members and the top expander; and shearing the frangible member to allow movement of the plurality of upper members with respect to the top expander.

8. The method as defined in claim 1, further comprising:

releasably connecting the anchor mandrel and a hydraulically set setting tool; and releasing the hydraulically set setting tool from the anchor mandrel once the anchor is set within the casing.

9. A method of setting an expandable anchor within a large diameter lower tubular after moving the expandable anchor through a small diameter upper tubular having an external diameter less than an internal diameter of the lower tubular, comprising:

releasably connecting a mandrel on the expandable anchor with a setting tool;

supporting a top expander on the mandrel, the top expander having a plurality of circumferentially spaced inclined external uniform curved surfaces that each have a continuous curvature;

supporting a plurality of movable upper members on the top expander;

supporting a bottom expander on the mandrel, the bottom expander having a plurality of circumferentially spaced inclined external uniform curved surfaces that each have a continuous curvature;

supporting a plurality of movable lower members on the bottom expander;

supporting a plurality of slips extending between and supported on the plurality of upper and lower movable members for engaging the lower tubular to secure the expandable anchor therein; and lowering the expandable anchor through the small diameter upper tubular and thereafter setting the expandable anchor within the large diameter lower tubular at a position below the upper tubular.

10. The method as defined in claim 9, further comprising:

forming an inclined internal uniform curved surface on each of the plurality of upper movable members to match a respective one of said external curved surfaces on the top expander; and forming an inclined internal uniform curved surface on each of the plurality of lower movable members to match a respective one of said external curved surfaces on the bottom expander.

11. The method as defined in claim 9, further comprising:

forming an inclined internal curved surface on each of the plurality of slips for engaging a respective one of the upper members and lower members in continuous sliding movement therebetween while inhibiting relative rotation therebetween.

12. The method as defined in claim 9, further comprising:

forming the plurality of inclined external surfaces on the top expander that each have the same continuous uniform radius as each of the inclined external surfaces on the bottom expander.

13. The method as defined in claim 9, further comprising:

providing a plurality of intermediate upper movable members each acting between a respective one of the plurality of upper movable members and a respective one of the plurality of slips; and providing a plurality of intermediate lower movable members each acting between a respective one of the plurality of lower movable members and a respective one of the plurality of slips.

14. The method as defined in claim 9, further comprising:

forming a dove-tail groove along a length of the inclined external curved surface on the top expander and the inclined external curved surface of the bottom expander for slidably interconnecting each expander with a respective movable member.

15. The method as defined in claim 9, further comprising:

positioning upper limit pins for limiting radial movement between respective groups of the plurality of movable upper members; and providing lower limit pins for limiting radial movement between respective groups of the plurality of movable lower members.

16. A method of setting a whipstock on an anchor secured at a selected downhole position in a large diameter tubular below a lower end of a small diameter tubular, comprising:

pivotably connecting a hinge assembly link with a first hinge pin pivotably connecting the hinge assembly link to a lower end of a whipstock body and a second hinge pin pivotably connecting the hinge assembly link to a lower hinge support;

lowering the whipstock through the small diameter tubular to a selected position in the large diameter tubular;

interconnecting the lower hinge support and the anchor; and pivoting the hinge assembly link for pivotal movement of the hinge assembly link about the first hinge pin with respect to the lower end of the whipstock body and about the second hinge pin with respect to the lower hinge support for engaging the whipstock body with the large diameter tubular.

17. The method as defined in claim 16, further comprising:

offsetting the first hinge pin and the second hinge pin in an opposite circumferential direction with respect to a centerline of the whipstock.

18. The method as defined in claim 16, further comprising:

providing a frangible member connecting the whipstock body and the hinge assembly link; and shearing the frangible member to allow pivoting of the hinge assembly link with respect to the whipstock body.

19. The method as defined in claim 16, further comprising:

engaging a lower end of the hinge assembly link with the large diameter tubular at a location circumferentially opposite the engagement of the whipstock body and the large diameter tubular to provide radial support for the set whipstock within the large diameter tubular.

* * * * *